US007871149B2

(12) United States Patent
Chikamoto et al.

(10) Patent No.: US 7,871,149 B2
(45) Date of Patent: Jan. 18, 2011

(54) HEAD UNIT AND INK-JET RECORDING APPARATUS HAVING THE SAME

(75) Inventors: Tadanobu Chikamoto, Nagoya (JP); Atsuo Sakaida, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 324 days.

(21) Appl. No.: 12/046,146

(22) Filed: Mar. 11, 2008

(65) Prior Publication Data

US 2008/0266353 A1 Oct. 30, 2008

(30) Foreign Application Priority Data

Mar. 12, 2007 (JP) ..... 2007-061308
Mar. 12, 2007 (JP) ..... 2007-061313

(51) Int. Cl.
*B41J 2/205* (2006.01)

(52) U.S. Cl. ..... 347/43; 347/72

(58) Field of Classification Search ..... 347/40, 347/43, 12, 15, 67–72
See application file for complete search history.

(56) References Cited

U.S. PATENT DOCUMENTS

| | | | |
|---|---|---|---|
| 6,123,410 | A | 9/2000 | Beerling et al. |
| 6,341,845 | B1 | 1/2002 | Scheffelin et al. |
| 6,779,871 | B1 | 8/2004 | Seto et al. |
| 7,374,276 | B2 | 5/2008 | Taira et al. |
| 2004/0201641 | A1 | 10/2004 | Brugue et al. |
| 2005/0057602 | A1 | 3/2005 | Okamoto |
| 2005/0219308 | A1 | 10/2005 | Nakashima |
| 2006/0050100 | A1 | 3/2006 | Kondoh et al. |
| 2006/0055740 | A1 | 3/2006 | Kondoh |
| 2006/0274100 | A1 | 12/2006 | Uji et al. |

FOREIGN PATENT DOCUMENTS

EP 1182037 A1 2/2002

(Continued)

OTHER PUBLICATIONS

Japan Patent Office, Office Action in Japanese Patent Application No. 2007-061308 (counterpart to the above-captioned U.S. Patent Application) mailed Jan. 27, 2009. (partial translation).

(Continued)

*Primary Examiner*—Lamson D Nguyen
(74) *Attorney, Agent, or Firm*—Baker Botts L.L.P.

(57) ABSTRACT

A head unit comprises: first and second heads, each having an ink ejecting face including a nozzle group, the nozzle group including plural nozzle rows extending in a first direction and arranged in a second direction orthogonal, each nozzle row including a plurality of nozzles for ejecting ink arranged along the first direction at a predetermined interval; and a holder for holding the first and second heads. Each of the nozzle groups of the first and second heads includes a rectangular region in which the plurality of nozzles are arranged apart at a predetermined distance in the first direction to form a rectangular shape. The first and second heads are held by the holder in parallel with each other so that the plurality of nozzles included in the rectangular regions of the first and second heads, respectively, are arranged apart at the predetermined distance in the first direction.

19 Claims, 17 Drawing Sheets

FOREIGN PATENT DOCUMENTS

| | | | |
|---|---|---|---|
| EP | 1231060 | A1 | 2/2002 |
| EP | 1518689 | A1 | 3/2005 |
| JP | H05-057965 | A | 3/1993 |
| JP | 2002-086735 | A | 3/2002 |
| JP | 2004-268326 | A | 9/2004 |
| JP | 2004-284253 | A | 10/2004 |
| JP | 2005-022117 | A | 1/2005 |
| JP | 2005-306008 | A | 11/2005 |
| JP | 2006-256315 | A | 9/2006 |
| JP | 2006-334994 | A | 12/2006 |
| WO | 2005108094 | A1 | 11/2005 |
| WO | 2007063671 | A1 | 6/2007 |

OTHER PUBLICATIONS

Japan Patent Office, Office Action in Japanese Patent Application No. 2007-061313 (counterpart to the above-captioned U.S. Patent Application) mailed Jan. 27, 2009. (partial translation).

European Patent Office, European Search Report for Related EP Application No. 08004510 dated Jun. 16, 2008.

HEAD UNIT AND INK-JET RECORDING APPARATUS HAVING THE SAME

CROSS-REFERENCE TO RELATED APPLICATION

This application claims priority from Japanese Patent Application No. 2007-061308, filed on Mar. 12, 2007, and Japanese Patent Application No. 2007-061313, filed on Mar. 12, 2007, the entire subject matter of which is incorporated herein by reference.

TECHNICAL FIELD

Aspects of the present invention relates to a head unit having a plurality of ink-jet heads for ejecting ink and an ink-jet recording device having the head unit.

BACKGROUND

JP-A-2004-284253 describes a long ink-jet recording head in which a plurality of actuator units having a trapezoidal planar shape are arranged in a zigzag manner. A plurality of the actuator units are used to constitute an ink-jet recording head, thereby eliminating the necessity for processing and forming a piezoelectric element from one sheet of a long piezoelectric plate even in the case of a long ink-j et recording head and also preventing a poor yield in production.

However, the ink-jet recording head described in JP-A-2004-284253, includes a plurality of nozzles, pressure chambers, and flow paths connecting the nozzles with the pressure chambers and the like since the head is long. Where any one of these plurality of nozzles, pressure chambers, flow paths and the like fails to satisfy a desired manufacturing standard (in other words, where a predetermined ink ejection performance from nozzles is not attained), it is necessary to produce again the long head. More specifically, if one head is made long, yield in the production of the head deteriorates.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide a head unit capable of attaining a higher yield than the manufacture of a single long ink-jet head and an ink-jet recording device having the head unit.

According to an exemplary embodiment of the present invention, there is provided a head unit comprising: first and second heads, each having an ink ejecting face including a nozzle group, the nozzle group including a plurality of nozzle rows extending in a first direction and arranged in a second direction orthogonal to the first direction, each nozzle row including a plurality of nozzles for ejecting ink arranged along the first direction at a predetermined interval; and a holder for holding the first and second heads, wherein each of the nozzle groups of the first and second heads includes a rectangular region in which the plurality of nozzles are arranged apart at a predetermined distance in the first direction to form a rectangular shape, and wherein the first and second heads are held by the holder in parallel with each other so that the plurality of nozzles included in the rectangular regions of the first and second heads, respectively, are arranged apart at the predetermined distance in the first direction.

According to an exemplary embodiment of the present invention, there is provided an ink-jet recording apparatus comprising the head unit; and a controller which controls the head unit to selectively eject ink.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Hereinafter, a description will be given of exemplary embodiments of the present invention by referring to drawings.

Figure 1:
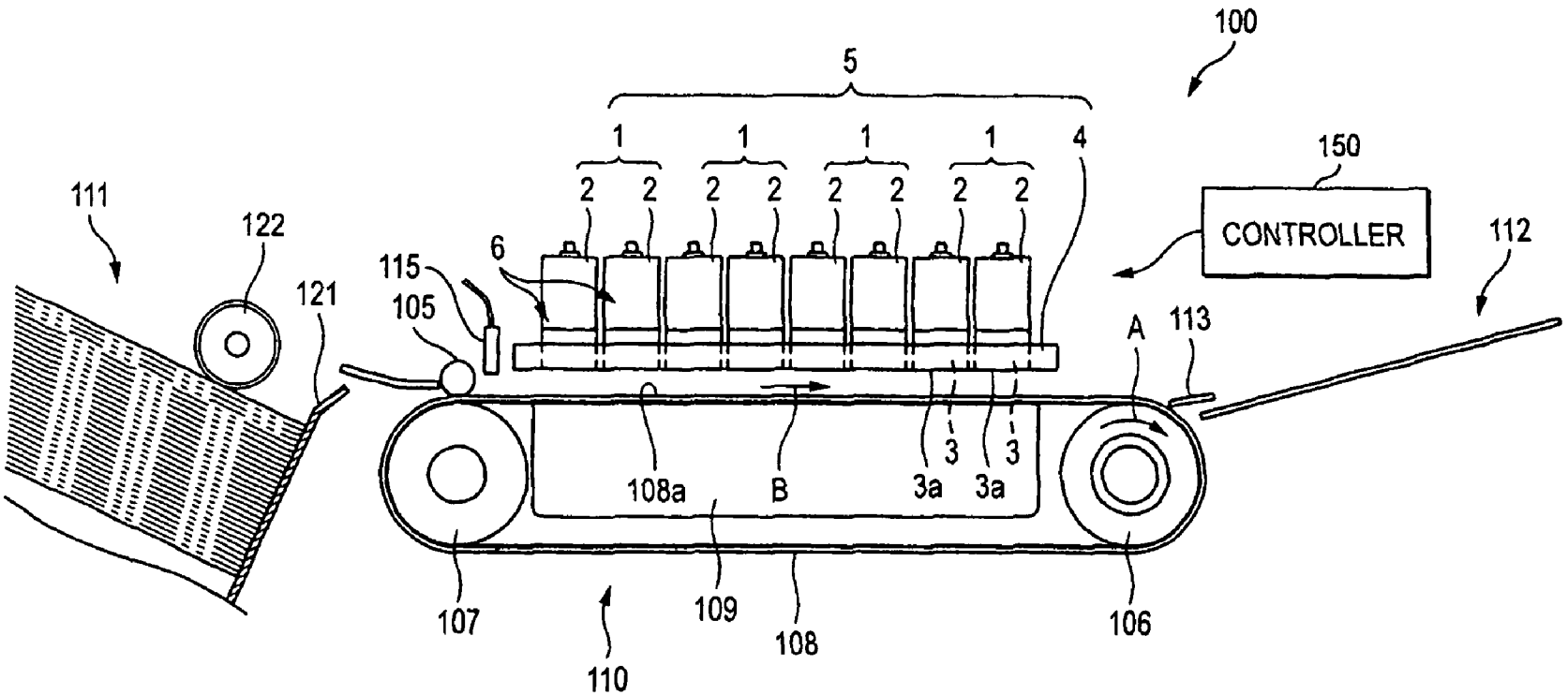
FIG. 1 is a general side cross sectional view showing an ink-jet printer according to a first exemplary embodiment of the present invention.
Figure 2:
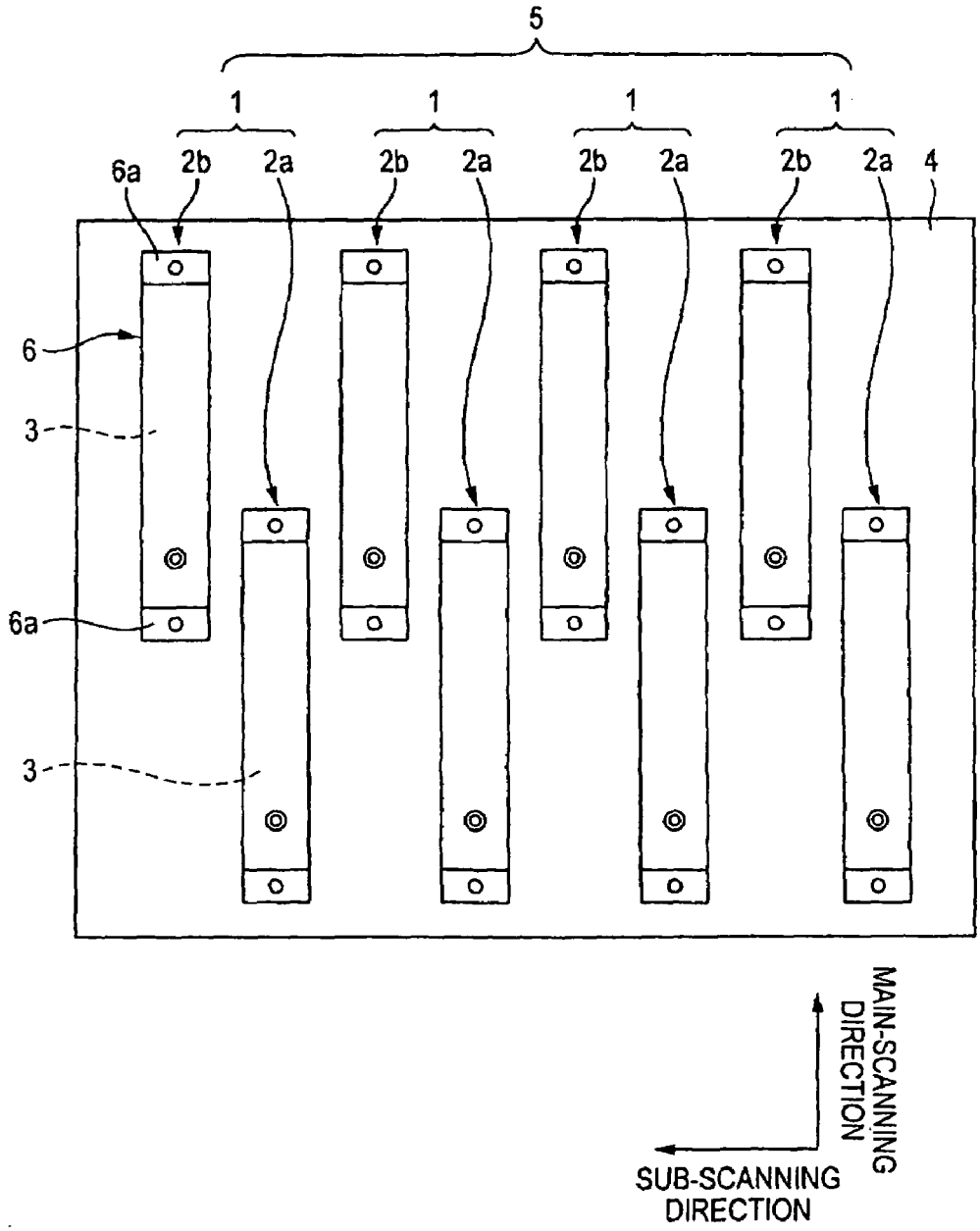
FIG. 2 is a plan view of a head unit shown in FIG. 1.

FIG. 1 is a brief side-cross sectional view of the ink-jet printer according to a first exemplary embodiment of the present invention. FIG. 2 is a plan view of a head unit shown in FIG. 1.

As shown in FIG. 1, an ink-jet printer 100 is a color ink-jet printer which ejects four different colors of ink from a plurality of ink-jet heads 2. The ink-jet printer 100 is provided with a sheet feeding mechanism 111 and a sheet discharging portion 112 respectively on the left and on the right as given in FIG. 1. A head unit 5 having four sets (one set made up of two ink-jet heads) of the ink-jet heads 2 is provided approximately at the midpoint therebetween. The printer 100 is also provided with a controller 150 for controlling operations of individual portions of the printer 100 such as the ink-jet head 2 and the sheet feeding mechanism 111.

A sheet conveying path through which sheets, as an example of recording media, are conveyed from the sheet feeding mechanism 111 to the sheet discharging portion 112 is formed inside the ink-jet printer 100. The sheet feeding mechanism 111 is provided with a pickup roller 122 which feeds out an uppermost sheet, of a plurality of sheets accommodated inside a sheet tray 121. The sheet is fed by the pickup roller 122 from the left to the right as given in FIG. 1.

At the midpoint of the sheet conveying path, there are arranged two belt rollers 106 and 107 and an endless conveyance belt 108 turned around these rollers 106 and 107 so as to be placed laterally therebetween. These belt rollers 106 and 107 and the conveyance belt 108 constitute a sheet conveying mechanism 110. Silicone treatment is given to the outer peripheral face of the conveyance belt 108, that is, conveying face 108*a*, which makes the face adhesive. A pressing roller 105 is arranged at a position facing the conveyance belt 108 immediately downstream of the sheet feeding mechanism 111, thereby pressing sheets fed out from the sheet feeding mechanism 111 to the conveying face 108*a* of the conveyance belt 108.

Thereby, the sheets pressed by the conveying face 108*a* are conveyed toward downstream, while they are retained due to the adhesiveness of the conveying face 108*a*. In this instance, the belt roller 106 located downstream in the sheet conveying direction is given driving force from a driving motor (not illustrated) to rotate in a clockwise direction as shown in FIG. 1 (the direction shown by Arrow A).

At the midpoint of the sheet conveying path as well, a region facing the ink-jet head 2 (head unit 5) is given as an image forming region at which an image is formed on a sheet. Further, a peeling member 113 is provided immediately downstream of the conveyance belt 108 along the sheet conveying path. The peeling member 113 is constituted in such a manner that a sheet retained on the conveying face 108*a* of the conveyance belt 108 is peeled from the conveying face 108*a* and sent to the sheet discharging portion 112 on the right.

A substantially rectangular-solid shape platen 109, which is in contact with the lower face of the conveyance belt 108 at the upper side, that is, at a position facing the ink-jet head 2, thereby supporting it from the inner peripheral side, is arranged in a region enclosed by the conveyance belt 108.

As shown in FIG. 1 and FIG. 2, the head unit 5 is provided with eight ink-jet heads 2 and a holder 4 for supporting the eight ink-jet heads 2. These eight ink-jet heads 2 are arrayed in two rows in a zigzag manner along the sub-scanning direction parallel to the sheet conveying direction B (the direction by Arrow B given in FIG. 1). The eight ink-jet heads 2 constitute one head set 1 for every two adjacent ink-jet heads 2*a* and 2*b*, and the head unit 5, therefore, has a total of four sets of the head set 1. The two ink-jet heads 2*a* and 2*b* constituting each head set 1 are fixed to the holder 4 parallel to each other so as to give a printing region length which is substantially equal to a printing region length obtained by adding in the main-scanning direction the printing region lengths of the two ink-jet heads 2*a* and 2*b* in the main-scanning direction (direction orthogonal to the sheet conveying direction B). Further, the tour head sets 1 eject ink of four different colors (magenta, yellow, cyan, black) from each set.

As shown in FIG. 1 and FIG. 2, each of the ink-jet heads 2 is formed in a thin rectangular-solid shape, the longitudinal direction of which extends in the main-scanning direction. Further, as shown in FIG. 1, a head main body 3 is provided at the lower end of the ink-jet head 2. A reservoir unit 6, which temporarily reserves ink supplied from an ink supply source (not illustrated) and supplies the thus reserved ink to the head main body 3, is fixed at the upper face of the head main body 3. The reservoir unit 6 is provided with a head fixing portion 6*a* formed longer than the head main body 3 in the main-scanning direction. As shown in FIG. 2, the head fixing portion 6*a* is formed so as to extend to both sides of the head main body 3 in the longitudinal direction (that is, both sides in the main-scanning direction) and fixed to the holder 4 with screws (not illustrated).

An opening portion (not illustrated), which is made open so as to correspond to the head main body 3 of each of the ink-jet heads 2, is formed on the holder 4, and the lower face of the head main body 3 (ink ejecting face 3*a* on which a plurality of nozzles 8 are formed) is exposed front the opening portion. In the constitution so far described, upon a sequential passage of sheets conveyed by the conveyance belt 108 immediately below the head main body 3, ink droplets of each color are ejected from the nozzle a (refer to FIG. 5) toward the upper face of a sheet. Thereby, a color image based on image data stored by the controller 150 is formed on the upper race of the sheet.

In addition, a sheet sensor 115 is installed between the pressing roller 105 and the head unit 5 in the sheet conveying direction B. The sheet sensor 115 is constituted with a light-emitting element and a light-receiving element and able to detect the leading end of a sheet on the conveying path. The result detected by the sheet sensor 115 is sent to a controller 150. The controller 150 is able to control the ink-jet head 2, the sheet feeding mechanism 111, the conveying mechanism 110 and others on the basis of the detection result sent from the sheet sensor 115 so that the conveyance of the sheet can be synchronized with the printing of an image.

Figure 3:
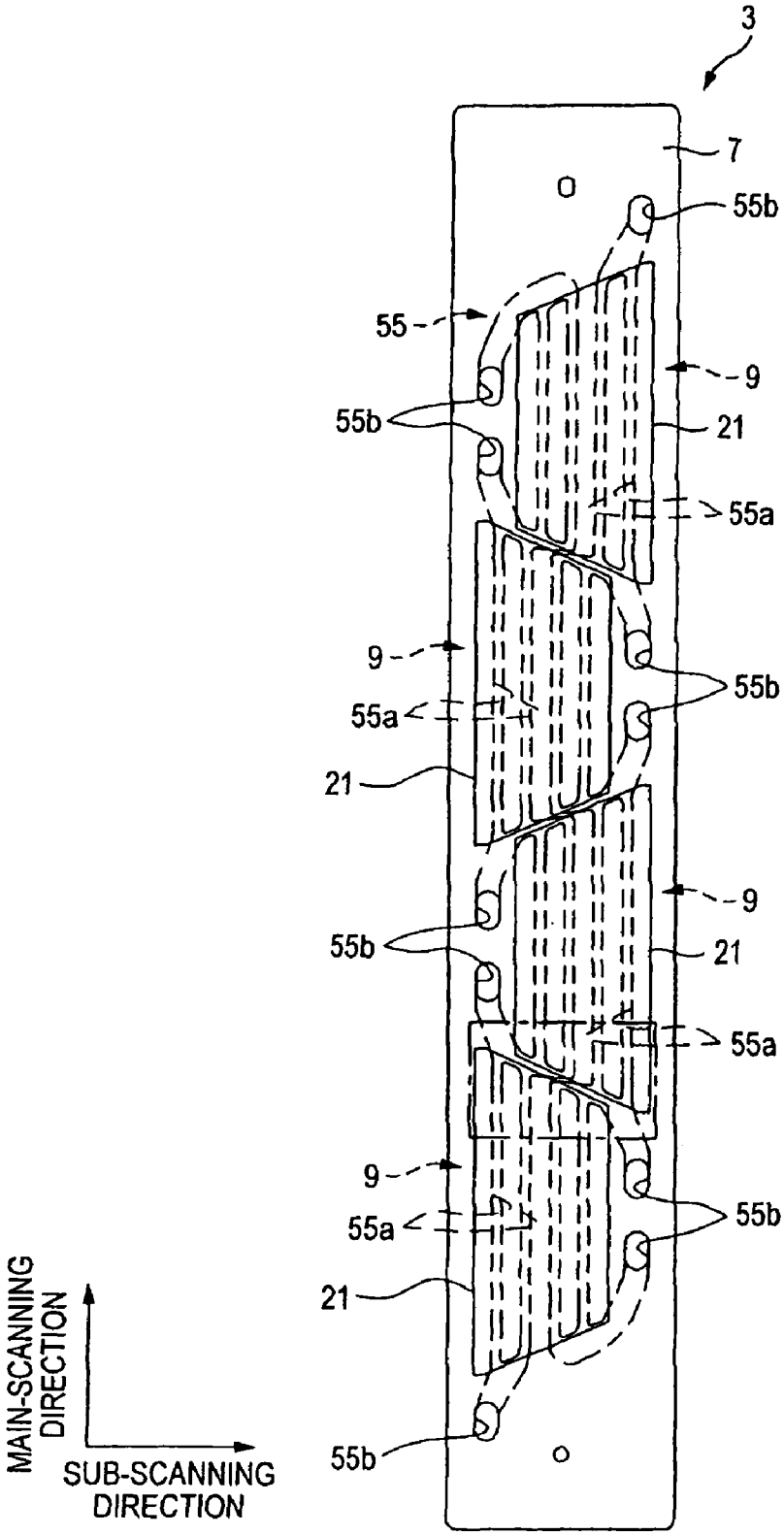
FIG. 3 is a plan view of a head main body shown in FIG. 1.

Next, a description will be given in detail of the head main body 3. FIG. 3 is a plan view of the head main body 3 given in FIG. 1. As shown in FIG. 3, the head main body 3 is provided with a flow path unit 7 at which an ink flow path is formed and four actuator units 21 attached on the upper face of the flow path unit 7. The flow path unit 7 is formed in a rectangular planar shape extending in the main-scanning direction. FIG. 3 shows by the broken line a manifold flow path 55, which is a common ink chamber installed inside the flow path unit 7. Ink is supplied from the reservoir unit 6 to the manifold flow path 55 through a plurality of openings 55*b*. The manifold flow path 55 is branched into a plurality of sub manifold flow paths 55*a* extending parallel to the longitudinal direction of the flow path unit 7.

Four actuator units 21 with a trapezoidal planar shape are arrayed in two rows in a zigzag manner on the upper face of the flow path unit 7 so as to avoid the openings 55*b* and attached on the upper face of the flow path unit 7. Each of the actuator units 21 is arranged in such a manner that the parallel opposing sides thereof (the upper side and the lower side) can run along the longitudinal direction of the flow path unit 7. A plurality of the openings 55*b* are arrayed in two rows along the longitudinal direction of the flow path unit 7, and a total of ten openings 55*b* (5 openings per row) are installed at such a position that will not interfere with the actuator unit 21. Further, the oblique sides of adjacent actuator units 21 are partially over lapped in the width direction of the flow path unit 7 (sub-scanning direction).

An ink ejecting face 3*a*, which is the lower face of the flow path unit 7, is given as an ink ejecting region at which multiple nozzles 8 (refer to FIG. 4 and FIG. 6) are arrayed in a matrix-like manner at a position facing the attached region of the actuator unit 21. A pressure chamber group 9 in which multiple pressure chambers 10 (refer to FIG. 4) are arrayed in a matrix-like manner are formed on the upper face of the flow path unit 7 facing the actuator unit 21. In other words, the actuator unit 21 has a dimension and a shape astride multiple pressure chambers 10 constituting the pressure chamber group 9.

Figure 4:
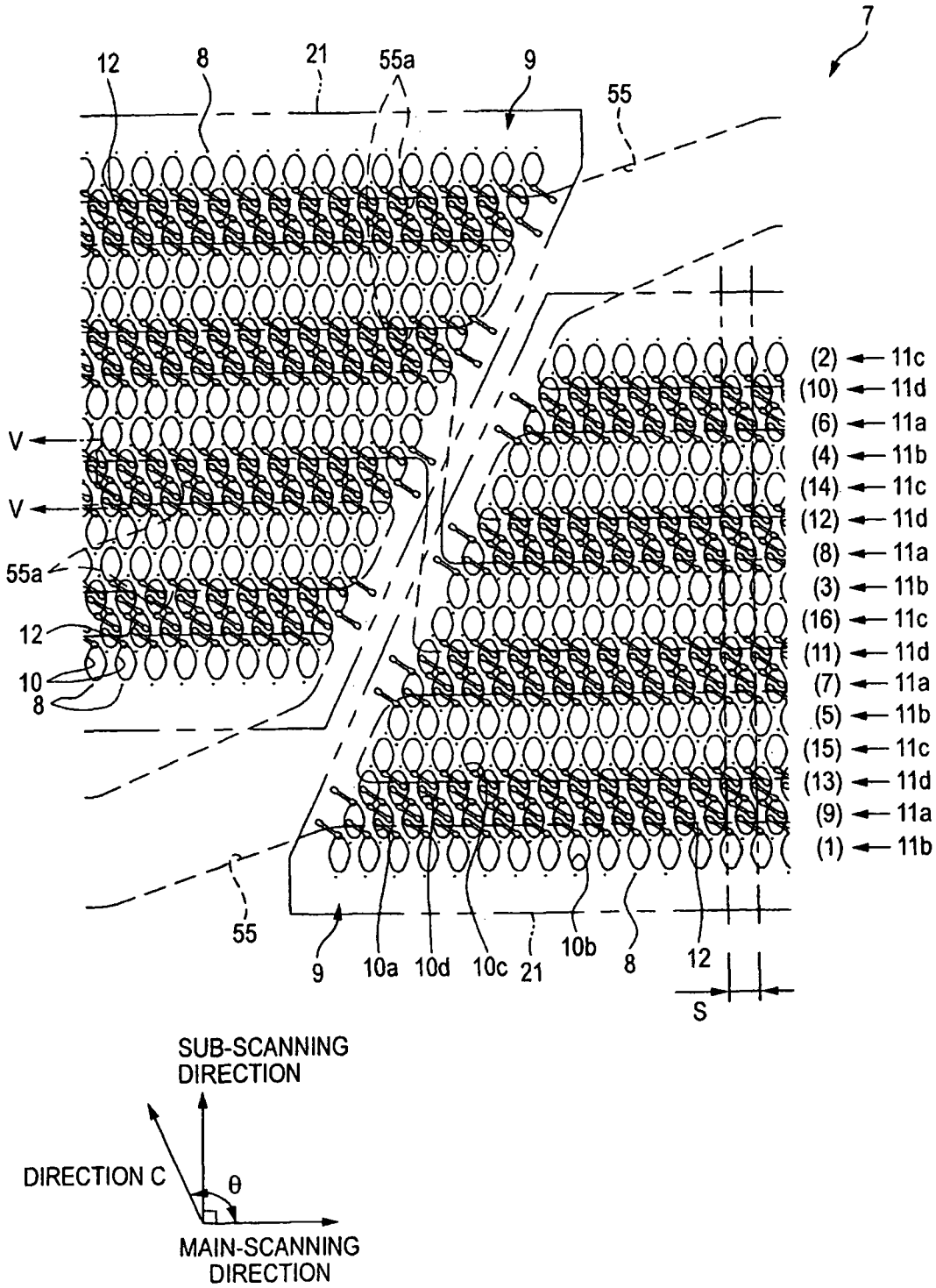
FIG. 4 is an enlarged view of a region enclosed by a single dotted and dashed line shown in FIG. 3.

FIG. 4 is an enlarged view of the region enclosed by the single dotted and dashed line given in FIG. 3. As shown in FIG. 4, four sub manifold flow paths 55*a* extend to a region overlapping the actuator unit 21 inside the flow path unit 7 parallel to the longitudinal direction of the flow path unit 7. Each of the sub-manifold flow paths 55*a* is connected to multiple individual ink flow paths 32 (to be described later) leading to each of the nozzles 8.

Figure 5:
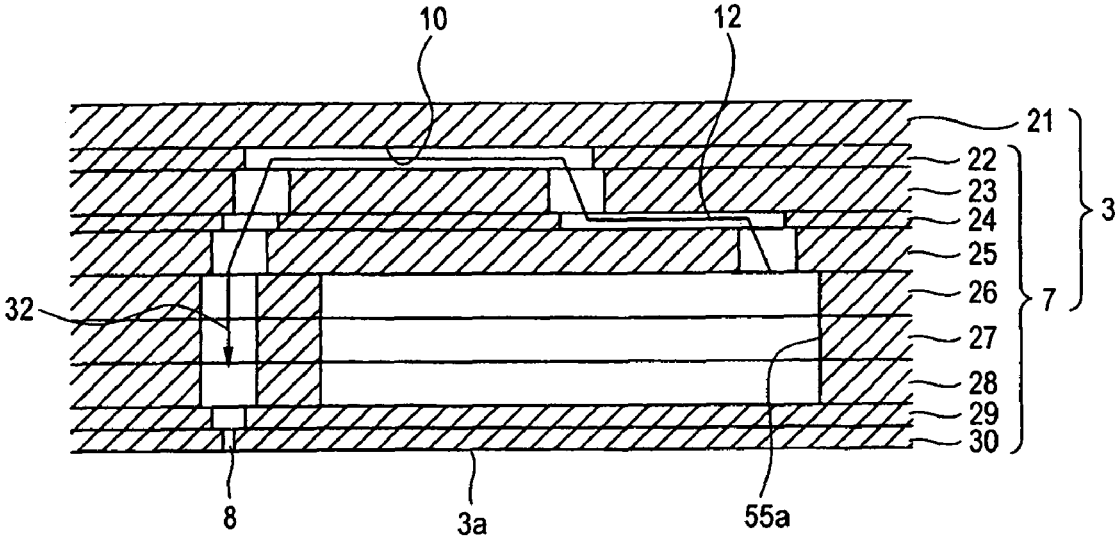
FIG. 5 is a cross sectional view showing an individual ink flow path.

FIG. 5 is a cross sectional view showing an individual ink flow path (a cross sectional view along the V-V line given in FIG. 4). As apparent from FIG. 5, each of the nozzles 8 is communicatively connected to a sub manifold flow path 55*a* via a pressure chamber 10 and an aperture 12. As described above, individual ink flow path 32 leading to the nozzle 8 from the exit of the sub manifold flow path 55*a* via the aperture 12 and the pressure chamber 10 is formed on the head main body 3 for every pressure chamber 10.

In the first exemplary embodiment, the individual ink flow path 32 is once directed upward, leading to one end of the pressure chamber 10 formed on the upper face of the flow path unit 7. Further, the individual ink flow path 32 is directed from the other end of the pressure chamber 10 extending horizontally toward an obliquely downward direction, joining to the nozzle 8 formed on the lower face of the flow path unit 7 (in other words, ink ejecting face 3*a*). As a whole, each of the individual ink flow paths 32 is formed in an arched shape, with the pressure chamber 10 given as an apex. Thereby, the individual ink flow paths 32 can be arranged in a highly dense manner to realize a smooth flow of ink.

As is apparent from FIG. 5, the head main body 3 is a laminated structure composed of an upper actuator unit 21 and a lower flow path unit 7. As will be described later in detail, of these components, to give the actuator unit 21, four piezoelectric sheets 41 to 44 (refer to FIG. 13) are laminated and an electrode is also arranged thereon. Further, of the four piezoelectric sheets contained in the actuator unit 21, only the uppermost sheet is a layer having a part which is activated on application of an electric field (hereinafter, simply referred to as "layer having an activated part"), and the three remaining layers are a non-activated layer free of the activated part.

On the other hand, in the flow path unit 7, a total of nine sheet members are laminated, that is, a cavity plate 22, a base plate 23, an aperture plate 24, a supply plate 25, manifold plates 26, 27, and 28, a cover plate 29 and a nozzle plate 30.

The cavity plate 22 is a metal plate on which multiple holes in a substantially rhomboidal shape (holes rounded at corners), each of which constitutes a clearance of the pressure chamber 10, are provided inside an attached range of the actuator unit 21. The base plate 23 is a metal plate on which a communicative hole between the pressure chamber 10 and the aperture 12 and a communicative hole between the pressure chamber 10 and the nozzle 8 are respectively provided for each pressure chamber 10 of the cavity plate 22.

The aperture plate 24 is a metal plate on which a hole used as the aperture 12 and also a communicative hole from the pressure chamber 10 to the nozzle 8 are respectively provided for each pressure chamber 10 of the cavity plate 22. The supply plate 25 is a metal plate on which a communicative hole between the aperture 12 and the sub-manifold flow path 55*a* and a communicative hole between the pressure chamber 10 and the nozzle 8 are respectively provided for each pressure chamber 10 of the cavity plate 22.

The manifold plates 26, 27, and 28 are metal plates on which, in addition to the sub-manifold flow path 55*a*, a communicative hole between the pressure chamber 10 and the nozzle 8 is provided respectively for each pressure chamber 10 of the cavity plate 22. The cover plate 29 is a metal plate on which a communicative hole from the pressure chamber 10 to the nozzle 8 is provided for each pressure chamber 10 of the cavity plate 22. The nozzle plate 30 is a metal plate on which a plurality of the nozzles 8 are installed. In regard to nozzles 8 of the nozzle plate 30, one nozzle is provided for each pressure chamber 10 of the cavity plate 22. These ten sheets 21 to 30 are positioned with respect to each other and laminated so as to form individual ink flow paths 32 as shown in FIG. 5.

As apparent from FIG. 5, the pressure chamber 10 is provided at a level different from that of the aperture 12 in the laminated direction of each of the plates. The aperture 12 is provided at a position deeper than the pressure chamber 10. Thereby, as shown in FIG. 4, the aperture 12 communicatively connected to one pressure chamber 10 inside the flow path unit 7 facing the actuator unit 21 can be arranged at a position which is the same as a different pressure chamber 10 adjacent to the relevant pressure chamber when viewed from above. As a result, the pressure chambers 10 are arrayed more densely and closely to each other, thus making it possible to print an image at a higher resolution by using an ink-jet head 2 relatively small in area.

Figure 6:
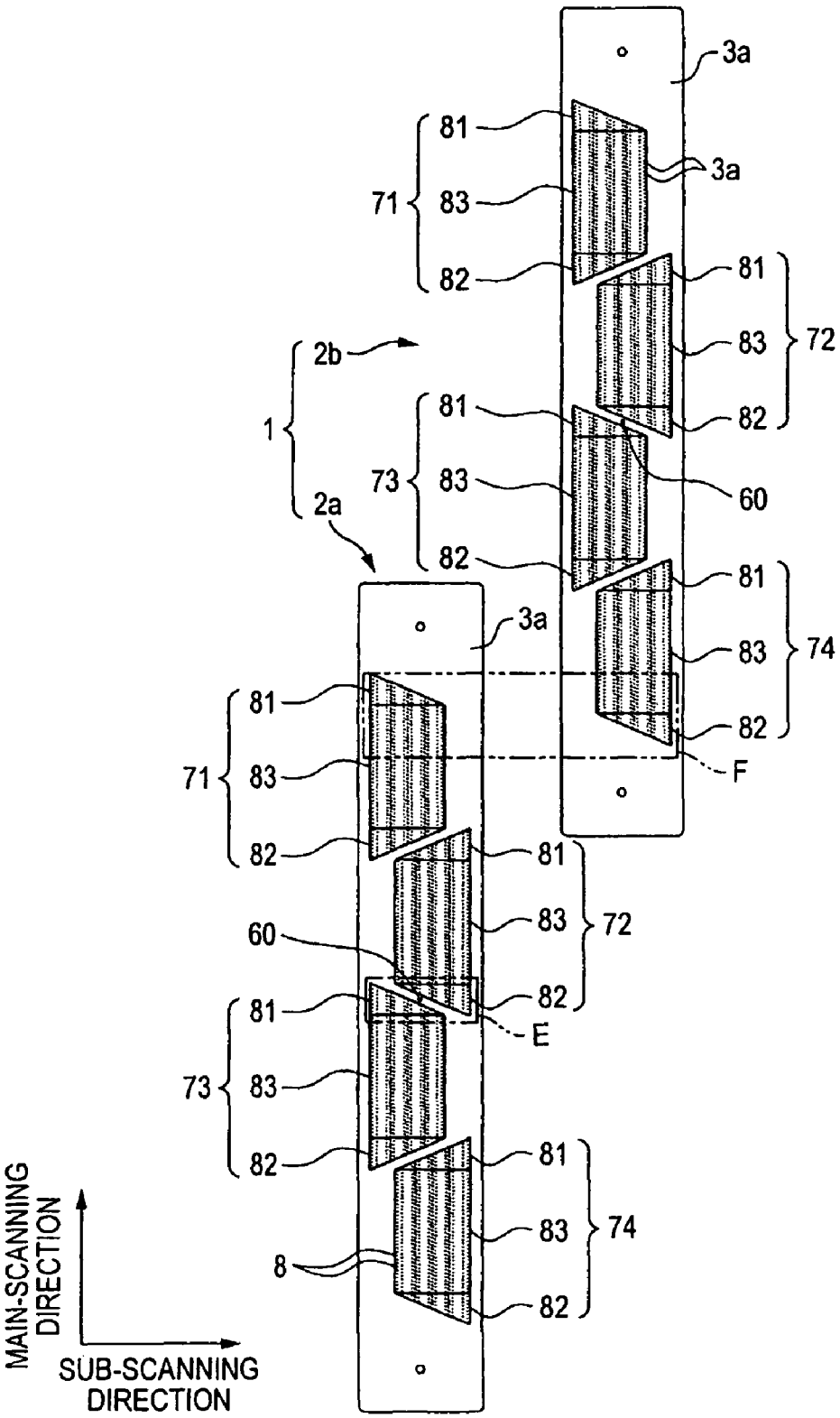
FIG. 6 is a plan view of the head main body of one head set when viewed from below.
Figure 7:
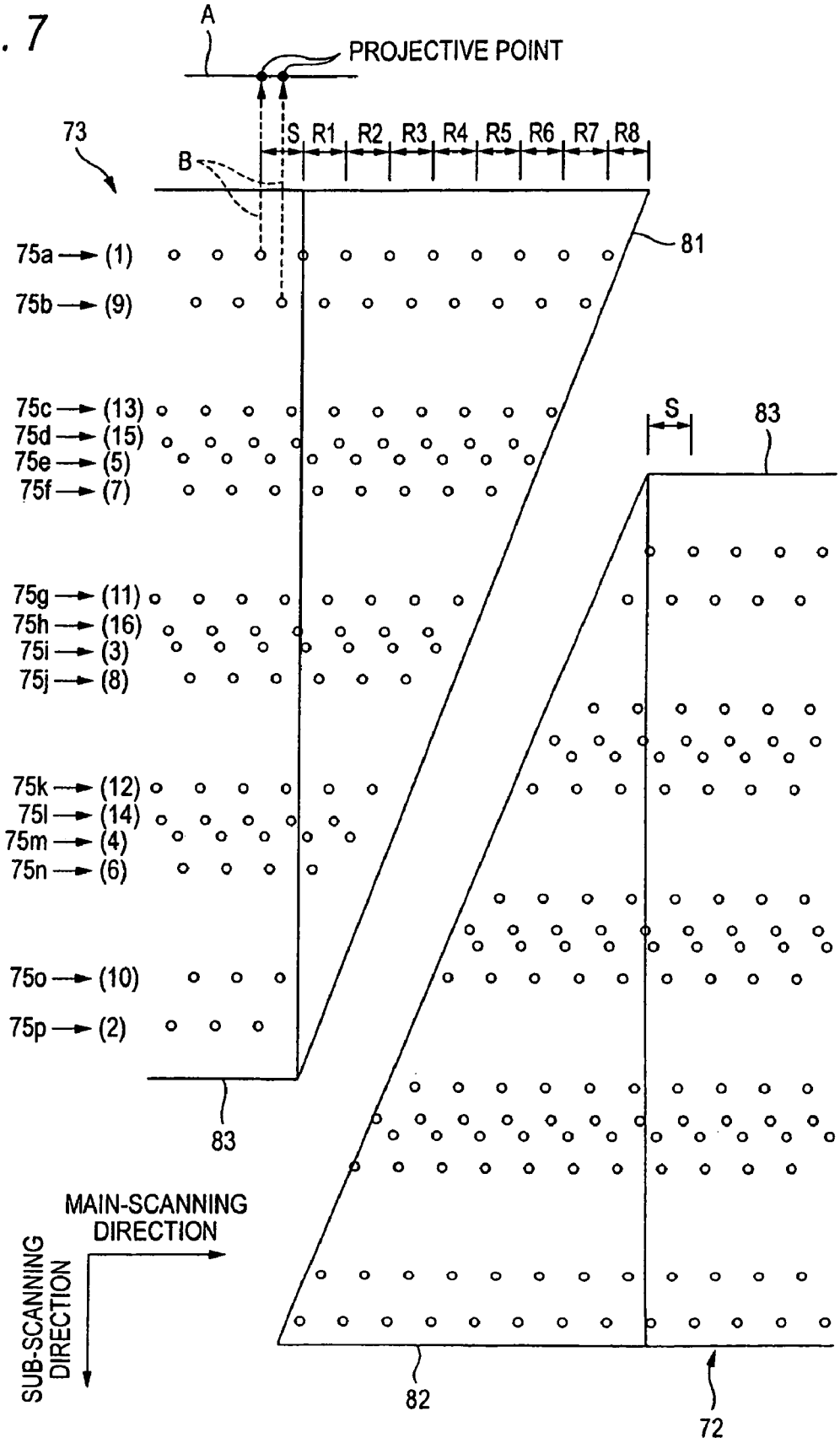
FIG. 7 is an enlarged plan view of a region E enclosed by a double dotted and dashed line shown in FIG. 6.

FIG. 6 is a plan view of the head main body 3 of one head set 1, when viewed from below. FIG. 7 is an enlarged plan view of the region E enclosed by the double dotted and dashed line given in FIG. 6. As shown in FIG. 6, four nozzle groups 71 to 74 in each of which a plurality of nozzles 8 are arranged adjacently in a matrix-like manner are formed on each of the ink ejecting faces 3*a* of two head main bodies 3 belonging to the head set 1 inside an ink ejecting region overlapped with a region occupied by the actuator unit 21 attached on the upper face of the flow path unit 7.

Four nozzle groups 71 to 74 are arrayed in two rows in a zigzag manner corresponding to the actuator units 21. These four nozzle groups 71 to 74 are formed in a trapezoidal planar shape and arranged in such a manner that the parallel opposing sides thereof run along the longitudinal direction (main-scanning direction) of the flow path unit 7.

As shown in FIG. 6, each of the nozzle groups 71 to 74 is made up of two triangular regions 81 and 82 constituted with a plurality of nozzles 8 in the vicinity of both ends in the main-scanning direction and one rectangular region 83 constituted with a plurality of nozzles 8, while commonly having a side of the two triangular regions 81 and 82 along the sub-scanning direction. A plurality of the nozzles 8 constituting the rectangular region 83 are arranged apart at a distance (42.3 μm) corresponding to 600 dpi along the main-scanning direction, as will be described later. Further, a plurality of the nozzles 8 constituting the triangular regions 81 and 82 are arranged apart in the main-scanning direction.

The four nozzle groups 71 to 74 are arranged in such a manner that adjacent triangular regions 81 and 82 overlap each other substantially over an entire region in the sub-scanning direction on each of the ink ejecting faces 3*a*. Further, the nozzle groups 71 to 74 are arranged in such a manner that four trapezoids formed by the nozzle groups 71 to 74 are given in point symmetry with respect to a point 60 located substantially at the center of the ink ejecting face 3*a*, and each of the nozzles 8 constituting the nozzle groups 71 to 74 is also arranged in such a manner so as to be in point symmetry with respect to the point 60.

As shown in FIG. 6 and FIG. 7, each of the nozzle groups 71 to 74 is provided with 16 nozzle rows 75 at which a plurality of nozzles 8 are arrayed in the main-scanning direction. The 16 nozzle rows 75 are arrayed parallel to each other, and a plurality of the nozzles 8 constituting each of the nozzle rows 75 are spaced at a distance (677.3 μm) corresponding to 37.5 dpi along the main-scanning direction.

Each of the nozzle rows 75 is arranged at a position so as not to face the four sub-manifold flow paths 55*a* (refer to FIG. 4). Every two nozzle rows 75 are correspondingly provided on both sides of one sub manifold flow path 55*a*. These nozzle rows 75 are decreased gradually in the number of nozzles constituting the nozzle row 75 as they come closer from the nozzle row 75 on the longer side of each of the nozzle groups 71 to 74 to the nozzle row 75 on the shorter side thereof. The nozzle groups 71 to 74 are accommodated inside an ink ejecting region.

FIG. 4 and FIG. 7 show a band region S which has a width corresponding to 37.5 dpi in the main-scanning direction at the rectangular region 83 and extends in the sub-scanning direction. The band region 8, even though it is assumed to be included in the rectangular region 83 of any nozzle group among the four nozzle groups 71 to 74, includes 16 nozzles 8 in the one nozzle group concerned. These 16 nozzles 8 all belong to different nozzle rows 75. The 16 nozzles 8 included in the band region S are projected on the straight line extending in the main-scanning direction to give projective points. These projective points are arranged on the straight line at an equal interval, and the interval is equal to a distance (42.3 μm) corresponding to 600 dpi, which is a resolution on printing.

In other words, all the nozzles 8 constituting the rectangular region 83 are arranged apart at a distance corresponding to 600 dpi in the main-scanning direction. In addition, the projective points at which the nozzles 8 are projected on a straight line (A) extending in the main-scanning direction are, as shown in FIG. 7, intersections between the straight line (A) and a straight line (B) parallel to the sub-scanning direction (direction orthogonal to the main-scanning direction) and passing through the nozzles 8.

Such assumption is made that when 16 nozzles 8 belonging to one band region S are projected on a straight line extending in the main-scanning direction, the nozzle 8, which is projected to the extreme left on the straight line, is given as (1). Further, the nozzles 8, which are projected at respective points apart rightward from the projective point (1) are given as (2) to (16) in the order closer to the projective point (1). These 16 nozzles 8 are arranged in the order of (1), (9), (13), (15), (5), (7), (11), (16), (3), (8), (12), (14), (4), (6), (10) and (2), when viewed from above in FIG. 7. Where the 16 nozzle rows 75 belonging to each of the nozzle groups 71 to 74 are given as a first nozzle row 75*a*, a second nozzle row 75*b* to a sixteenth nozzle row 75*p* sequentially from the upper side to the lower side in FIG. 7, there is found such an arrangement that the nozzle (1) belongs to the nozzle row 75*a* and the nozzle (9) belongs to the nozzle row 75*b* adjacent to the nozzle row 75*a*.

As described above, when attention is paid to a single nozzle 8 at one band region S, two nozzles 8 arranged on both sides of the nozzle 8 in the main-scanning direction are both located either above (upstream side) or below (downstream side) in the sub-scanning direction (sheet-conveying direction). Further, the nozzle 8 to which attention has been paid and the two nozzles 8 are arranged via at least one or more nozzles 8 (nozzle row 75) in the sub-scanning direction. Still further, the 16 nozzles 8 are arranged in a zigzag manner in the main-scanning direction.

Trapezoids made by adjacent nozzle groups 71 to 74 on each of the ink ejecting faces 3*a* are overlap in the sub-scanning direction in such a manner that the oblique sides of two adjacent trapezoids are parallel to each other and also located at the same position in the main-scanning direction. Specifically, a triangular region 82 of the nozzle group 71 overlaps with a triangular region 81 of the nozzle group 72, a triangular region 82 of the nozzle group 72 overlaps with the triangular region 81 of the nozzle group 73, and the triangular region 82 of the nozzle group 73 overlaps with the triangular region 81 of the nozzle group 74 over the entire region in the sub-scanning direction.

As described above, the adjacent triangular regions 81 and 82 overlap each other in the sub-scanning direction, because the overlapped triangular regions 81 and 82 are mutually given a complementary relationship with respect to the arrangement of the nozzles 8, thereby attaining a continuous printing over the entire width of one ink-jet head 2 in the main-scanning direction. In addition, on the assumption of a band region R similar to the rectangular region 83 in the thus overlapped regions 81 and 82, there is found a relative positional relationship in the nozzles 8 inside the band region R similar to the nozzles 8 in the rectangular region 83. In this instance, among the nozzles 8 belonging to two adjacent nozzle groups, it is necessary to consider a spaced portion (distance) of these two nozzle groups in the sub-scanning direction. However, all the nozzles 8 are arranged in an equal interval corresponding to the resolution of printing in the main-scanning direction.

Figure 8:
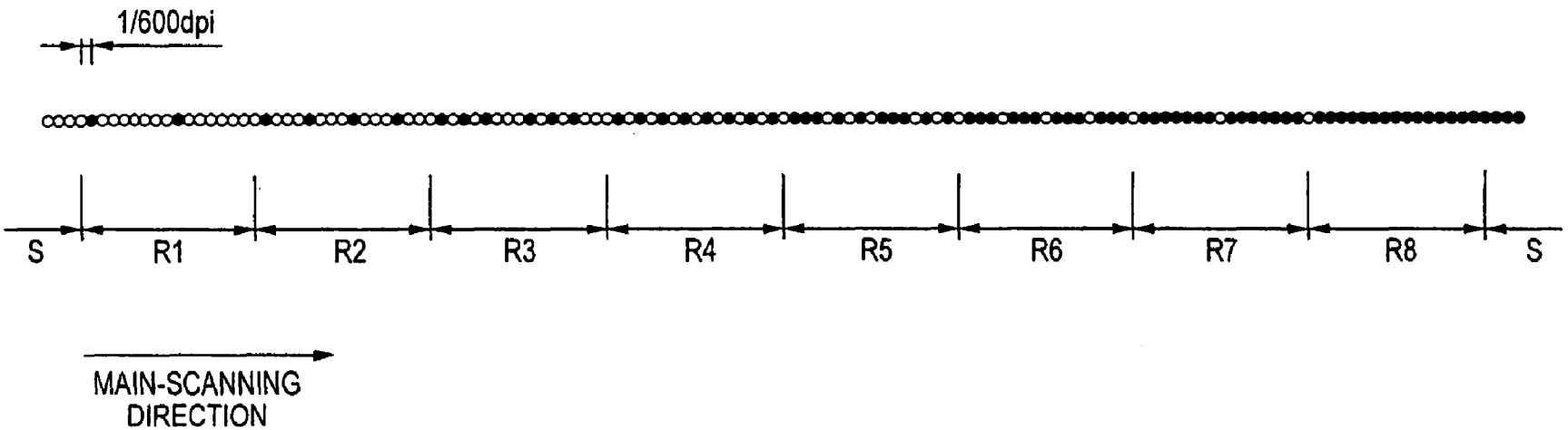
FIG. 8 is a drawing showing projective points projected on a straight line extending in a main-scanning direction from nozzles belonging to triangular regions overlapped with each other in a sub-scanning direction and the vicinity of the regions.

Here, a description will be given in detail of a constitution in which the triangular regions 81 and 82 are overlapped substantially over the entire region in the sub-scanning direction, while the triangular regions 81 and 82 belonging to mutually different nozzle groups 71 to 74 are given a complementary relationship. FIG. 8 is a drawing showing projective points projected on a straight line extending in the main-scanning direction from nozzles belonging to triangular regions overlapping each other in the sub-scanning direction and the vicinity of the regions. In addition, in FIG. 8, white circles represent points projected from the nozzles 8 belonging to the triangular region 81 and black circles represent points projected from the nozzles 8 belonging to the triangular region 82.

FIG. 7 shows a plurality of band regions R1 to R8 having a width (677.3 μm) corresponding to 37.5 dpi in the main-scanning direction and extending in the sub-scanning direction at a region where the triangular region 81 of the nozzle group 73 of the ink-jet head 2 and the triangular region 82 of the nozzle group 72 are overlapped. They are shown sequentially from the left to the right in FIG. 7. Each of the band regions R1 to R8 includes at least one or more of nozzles 8 belonging respectively to the triangular regions 81, 82, with a total of 16 nozzles 8 included. These 16 nozzles 8 all belong to different nozzle rows 75.

As shown in FIG. 8, the 16 nozzles 8 included in each of the eight band regions R1 to R8 are projected on a straight line extending in the main-scanning direction to give projective points. These projective points are arranged on the straight line at equal intervals, and the intervals are equal to a distance (42.3 μm) corresponding to 600 dpi, which is a resolution on printing. In other words, all the nozzles 8 constituting the overlapped triangular regions 81 and 82 are arranged apart at a distance corresponding to 600 dpi in the main-scanning direction.

In addition, as shown in FIG. 8, when consideration is given only to the points projected from the nozzles 8 belonging to the triangular region 81 (white circles) and the points projected from the nozzles 8 belonging to the triangular region 82 (black circles), both of these circles are arranged apart in the main-scanning direction but not arranged at an equal interval or at a distance corresponding to 600 dpi.

As shown in FIG. 8, the band region R1 includes 14 nozzles 8 belonging to the triangular region 81 and two nozzles 8 belonging to the triangular region 82. These 16 nozzles 8 are arranged in the main-scanning direction in such a manner that at least one or more of nozzles 8 belonging to different triangular regions 81, 82 are mutually held therebetween.

More specifically, as shown in FIG. 8, two nozzles 8 belonging to the triangular region 82 hold therebetween seven nozzles 8 belonging to the triangular region 81 in the main-scanning direction. Further, these two nozzles 8 belonging to the triangular region 82 are respectively held at the band region R1 by the first nozzle 8 and the third nozzle 8 and by the ninth nozzle 8 and the eleventh nozzle 8 on the left in FIG. 8 among these nozzles 8 belonging to the triangular region 81.

The band region R2 includes 12 nozzles 8 belonging to the triangular region 81 and four nozzles 8 belonging to the triangular region 82. The band region R3 includes 10 nozzles 8 belonging to the triangular region 81 and six nozzles 8 belonging to the triangular region 82. These 16 nozzles 8 in each of the band regions R2 and R3 are also arranged in the main-scanning direction in such a manner that at least one or more of the nozzles 8 belonging to different triangular regions 81, 82 are mutually held therebetween.

The band region R4 includes eight nozzles 8 belonging to the triangular region 81 and eight nozzles 8 belonging to the triangular region 82. These 16 nozzles 8 are arranged alternately in such a manner that each of the nozzles 8 belonging to different triangular regions 81, 82 is held therebetween in the main-scanning direction.

The band region R5 includes six nozzles 8 belonging to the triangular region 81 and 10 nozzles a belonging to the triangular region 82. The band region R6 includes four nozzles 8 belonging to the triangular region 81 and 12 nozzles 8 belonging to the triangular region 82. These 16 nozzles 8 in each of the band regions R5 and R6 are also arranged in the main-scanning direction in such a manner that at least one or more of the nozzles 8 belonging to different triangular regions 81, 82 are mutually held therebetween.

The band region R7 includes two nozzles 8 belonging to the triangular region 81 and 14 nozzles 8 belonging to the triangular region 82. These 16 nozzles 8 are also arranged in the main-scanning direction in such a manner that at least one or more of the nozzles 8 belonging to different triangular regions 81, 82 are mutually held therebetween. The band region R8 includes one nozzle 8 belonging to the triangular region 81 and 15 nozzles 8 belonging to the triangular region 82.

As described above, at the band regions R1 to R8, 16 nozzles 8 in which at least one or more of nozzles 8 belonging to the triangular regions 81, 82 are included are arranged apart at a distance corresponding to 600 dpi in the main-scanning direction, and nozzles a belonging to the overlapped triangular regions 81, 82 constitute a complementary relationship. Thereby, printing can be made continuously over the entire width of one ink-jet head 2 in the main-scanning direction.

In addition, a net width at which the four nozzle groups 71 to 74 can make a continuous printing is equal to the length of a line segment on which projective points obtained by projecting each of the nozzles 8 included in the four nozzle groups 71 to 74 on a straight line extending in the main-scanning direction are arranged at equal intervals on the straight line.

The length of the line segment of one ink-jet head 2 is equal to a length obtained by subtracting widths of the triangular region 81 of the nozzle group 71 and the triangular region 82 of the nozzle group 74, the nozzle groups being at the outermost positions in the main-scanning direction, from a width in the main-scanning direction of the four nozzle groups 71 to 74.

In the first exemplary embodiments one head set 1 is constituted with two ink-jet heads 2. Two ink-jet heads 2*a* and 2*b* are arranged parallel to each other in such a manner that the triangular region 81 and a portion of the rectangular region 83 (a first and a second region 83*a*, 83*b* to be described later) of the nozzle group 71 of one ink-jet head 2*a* belonging to the head set 1 and located obliquely below on the left in FIG. 6 overlap in the sub-scanning direction with the triangular region 82 and a portion of the rectangular region 83 (the first and the second region 83*a*, 83*b* to be described later) of the nozzle group 74 of the other ink-jet head 2*b* located obliquely above on the right in FIG. 6. Thereby, a net width at which the head set 1 can make a continuous printing is substantially equal to a length obtained by subtracting widths of the triangular region 81 of the nozzle group 71 and the triangular region 82 of the nozzle group 74, the nozzle groups being at the outermost positions in the main-scanning direction, from a width in the main-scanning direction of the eight nozzle groups 71 to 74 belonging to the head set 1.

Figure 9:
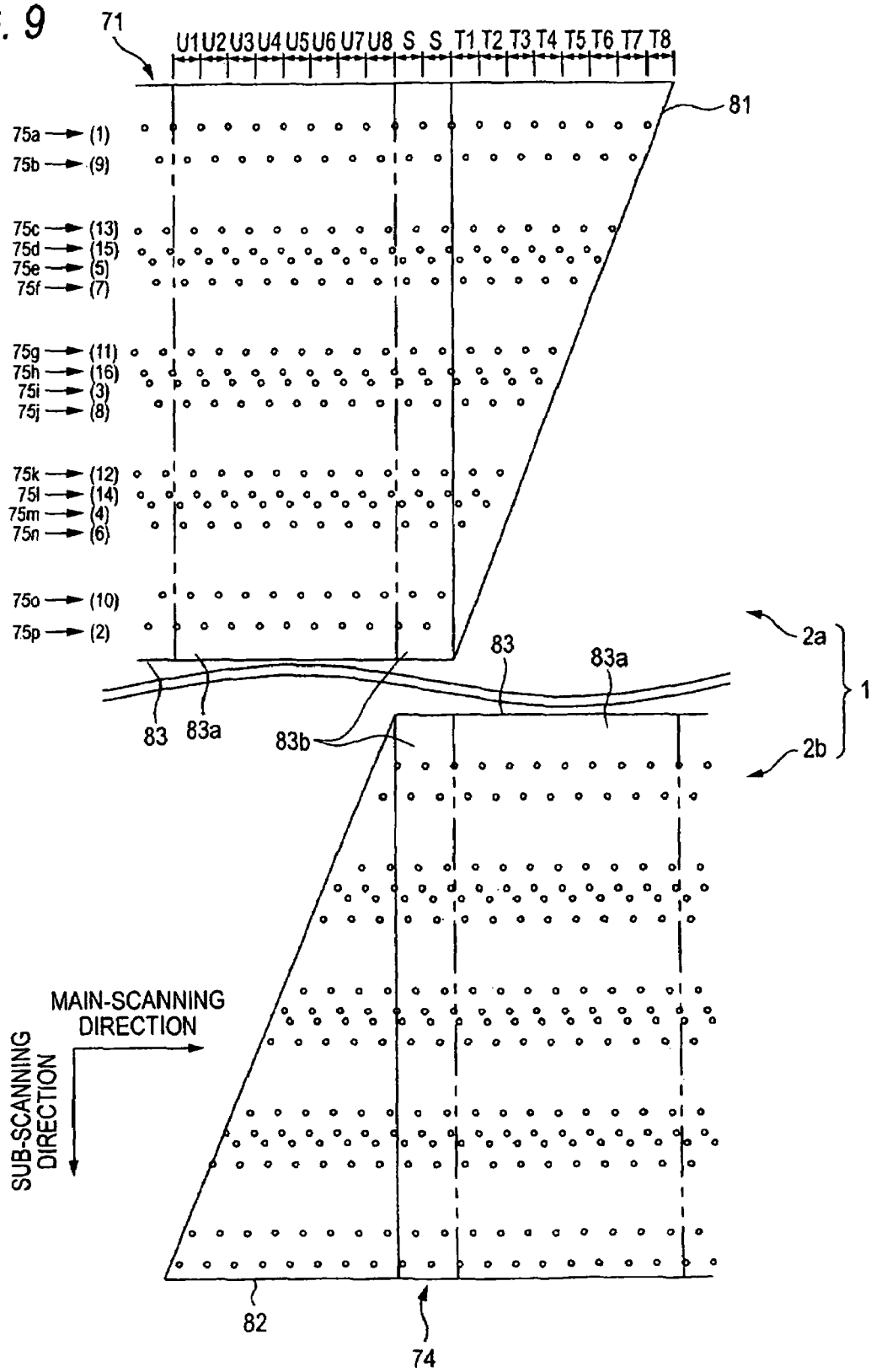
FIG. 9 is an enlarged plan view showing a region F enclosed by a double dotted and dashed line shown in FIG. 6.

Here, a description will be given in detail by referring to FIG. 9 to FIG. 11 of a constitution in which the nozzle group 71 of one ink-jet head 2*a* is overlapped with the nozzle group 74 of the other ink-jet head 2*b* in the sub-scanning direction. FIG. 9 is an enlarged plan view of a region F enclosed by the double dotted and dashed line given in FIG. 6. In addition, FIG. 9 is drawn by bringing the nozzle group 71 belonging to one ink-jet head 2*a* closer in the sub-scanning direction to the nozzle group 74 of the other ink-jet head 2*b* for easy understanding of the drawing.

Figure 10:
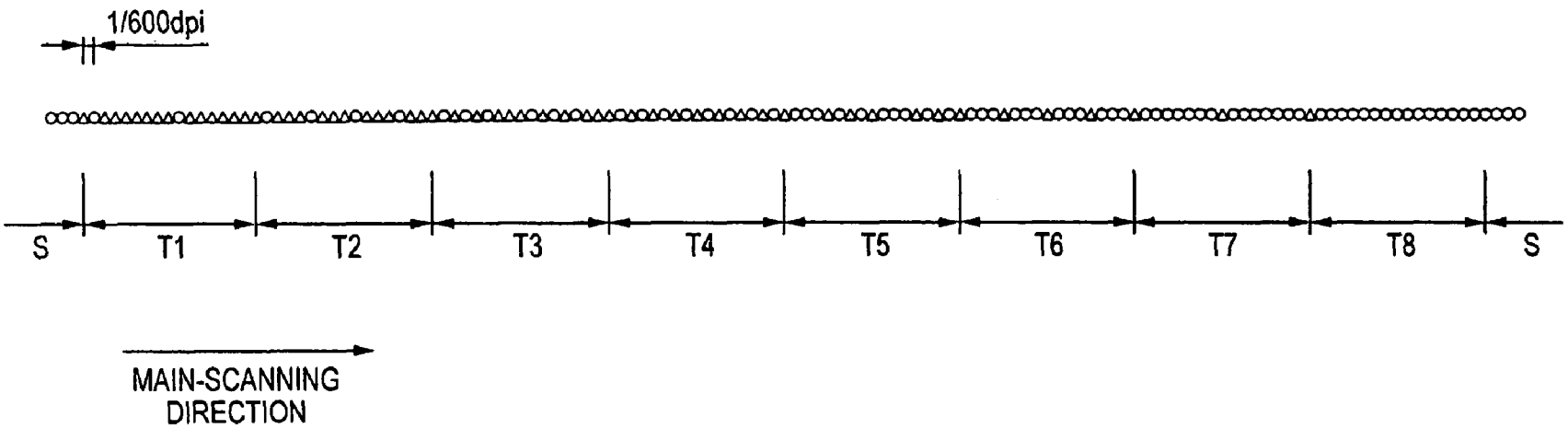
FIG. 10 is a drawing showing projective points projected on a straight line extending in the main-scanning direction from nozzles belonging to a region where a triangular region of one of the ink-jet head is overlapped in the sub-scanning direction with a portion of a rectangular region of the other of the ink-jet head and the vicinity of the region.

FIG. 10 is a drawing which shows projective points projected on a straight line extending in the main-scanning direction from nozzles belonging to a region, at which the triangular region 81 of one ink-jet head 2*a* and a portion of the rectangular region 83 of the other ink-jet head 2*b* are overlapped in the sub-scanning direction, and the vicinity of the region.

In addition, in FIG. 10, white circles represent points projected from the nozzles 8 belonging to the rectangular region 83 of the other ink-jet head 2*b* not overlapped with the nozzles 8 belonging to the triangular region 81 of one ink-jet head 2*a* in the sub-scanning direction, and white triangles represent points projected from the nozzles 8 belonging to the rectangular region 83 of the other ink-jet head 2*b* overlapped with the nozzles 8 belonging to the triangular region 81 of one ink-jet head 2*a* in the sub-scanning direction. In other words, the white triangles are points projected from the nozzles 8 belonging to the triangular region 81 of one ink-jet head 2*a*, and points projected from the nozzles 8 belonging to the rectangular region 83 of the other ink-jet head 2*b* are included both in the white circles and the white triangles.

Figure 11:
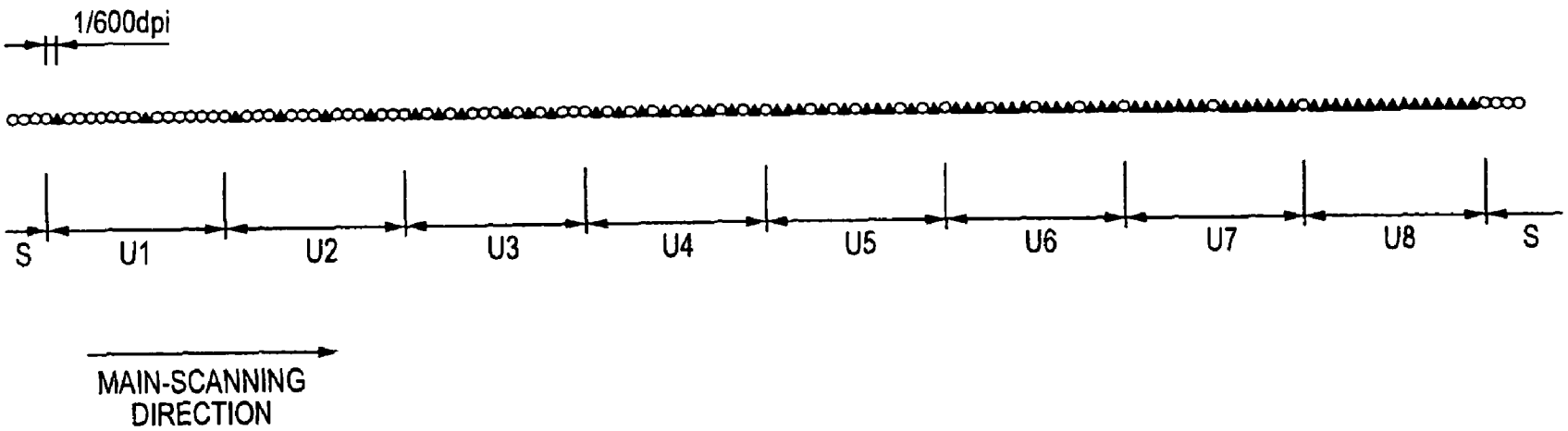
FIG. 11 is a drawing showing projective points projected on a straight line extending in the main-scanning direction from nozzles belonging to a region where a triangular region of the other of the ink-jet head is overlapped in the sub-scanning direction with a portion of the rectangular region of one of the ink-jet head and the vicinity of the region.

FIG. 11 is a drawing which shows projective points projected on a straight line extending in the main-scanning direction from nozzles belonging to a region, at which the triangular region 82 or the other ink-jet head 2*b* and a portion of the rectangular region 83 of one ink-jet head 2*a* are overlapped in the sub-scanning direction, and the vicinity of the region. In addition, in FIG. 11, white circles represent points projected from the nozzles 8 belonging to the rectangular region 83 of one ink-jet head 2*a* not overlapped in the sub-scanning direction with the nozzles a belonging to the triangular region 82 of the other ink-jet head 2*b*, and black triangles represent points projected from the nozzles 8 belonging to the rectangular region 83 of one ink-jet head 2*a* overlapped in the sub-scanning direction with the nozzles 8 belonging to the triangular region 82 of the other ink-jet head 2*b*. In other words, the black triangles are points projected from the nozzles 8 belonging to the triangular region 82 of the other ink-jet head 2*b*, and points projected from the nozzles 8 belonging to the rectangular region 83 of one ink-jet head 2*a* are included both in the white circles and the black triangles.

As shown in FIG. 9, the triangular region 81 of one ink-jet head 2*a* is overlapped in the sub-scanning direction over the entire region with the first region 83*a* of the rectangular region 83 of the other ink-jet head 2*b*. The triangular region 82 of the other ink-jet head 2*b* is overlapped in the sub-scanning direction over the entire region with the first region 83*a* of the rectangular region 83 of one ink-jet head 2*a*. The first regions 83*a* of the rectangular regions 83 of one and the other ink-jet heads 2*a* and 2*b* are equal in width in the main-scanning direction.

Then, the second region 83*b* of the rectangular region 83 between the first region 83*a* of the rectangular region 83 and the triangular region 81 of one ink-jet head 2*a* is overlapped in the sub-scanning direction over the entire region with the second region 83*b* of the rectangular region 83 between the first region 83*a* of the rectangular region 83 and the triangular region 81 of the other ink-jet head 2*b*.

The nozzles 8 belonging to the second regions 83*b* of one and the other ink-jet heads 2*a* and 2*b* overlap each other in the sub-scanning direction. The thus overlapped second regions 83*b* have, as shown in FIG. 9, a width in which two band regions S are assumable.

In addition, in each of the band regions S assumed in the region, points projected from the nozzles 8 belonging to the second region 83*b* of one ink-jet head 2*a* are overlapped with points projected from nozzles belonging to the second region 83*b* of the other ink-jet head 2*b*. Therefore, in the first exemplary embodiment, ink is ejected from the nozzles 8 belonging to the second region 83*b* of one ink-jet head 2*a* but no ink is ejected from the nozzles 8 belonging to the second region 83*b* of the other ink-jet head 2*b*.

The nozzles 8 belonging to the triangular region 81 of one ink-jet head 2*a* are overlapped with each other in the sub-scanning direction with the nozzles 8 belonging to the first region 83*a* of the other ink-jet head 2*b*. In the first exemplary embodiment, ink is ejected from all the nozzles 8 belonging to the triangular region 81 overlapped with the first region 83*a* but no ink is ejected from the nozzles 8 overlapped with the nozzles 8 belonging to the triangular region 81 among the nozzles 8 belonging to the first region 83*a* overlapped with the triangular region 81.

Further, the nozzles 8 belonging to the triangular region 82 of the other ink-jet head 2*b* are overlapped with each other in the sub-scanning direction with the nozzles 8 belonging to the first region 83*a* of one ink-jet head 2*a*. In the first exemplary embodiment, ink is ejected from all the nozzles 8 belonging to the triangular region 82 overlapped with the first region 83*a*, but no ink is ejected from the nozzles 8 overlapped with the nozzles 8 belonging to the triangular region 82 among the nozzles 8 of the first region 83*a* overlapped with the triangular region 82.

FIG. 9 shows a plurality of band regions T1 to T8 having a width (677.3 μm) corresponding to 37.5 dpi in the main-scanning direction and extending in the sub-scanning direction at a region where triangular region 81 of one ink-jet head 2*a* belonging to one head set 1 and the first region 83*a* of the other ink-jet head 2*b* are overlapped. They are shown sequentially from the left to the right in FIG. 9. Each of the band regions T1 to T8 includes at least one or more of the nozzles 8 belonging to the triangular regions 81 and the first region 83*a* overlapped therewith, respectively, with a total of 16 ink-ejecting nozzles 8 included. All of these 16 nozzles 8 belong to different nozzle rows 75.

At the band regions T1 to T8, where nozzles 8 from which no ink is ejected, that is, the nozzles 8 belonging to the first region 83*a* overlapped with the nozzles 8 belonging to the triangular region 81 are included, the total number of the nozzles are changed for each of the band regions T1 to T8. However, where nozzles 8 from which ink is ejected, that is, only the nozzles 8 belonging to the triangular region 81 and the nozzles 8 belonging to the first region 83*a* not overlapped with these nozzles 8 are counted, the total of 16 nozzles 8 are included at each of the band regions T1 to T8.

As shown in FIG. 10, the 16 ink-ejecting nozzles 8 included at each of the eight band regions T1 to T8 are projected on a straight line extending in the main-scanning direction to give projective points. These projective points are arranged on the straight line at equal intervals, and the intervals are equal to a distance (42.3 μm) corresponding to 600 dpi. In other words, all the ink-ejecting nozzles 8 constituting the triangular regions 81 and the first region 83*a* that are overlapped, are arranged apart at a distance corresponding to 600 dpi in the main-scanning direction.

As shown in FIG. 10, when consideration is given only to the points projected from the nozzles 8 belonging to the triangular region 81 (white triangles), the nozzles 8 belonging to the triangular region 81 are arranged apart in the main-scanning direction but not arranged at an equal interval apart at a distance corresponding to 600 dpi. Since the white circles and white triangles are both points projected from the nozzles 8 belonging to the first region 83*a*, the nozzles 8 belonging to the first region 83*a* are arranged in the main-scanning direction at equal intervals apart at a distance corresponding to 600 dpi even in a single arrangement.

As shown in FIG. 10, the band region T1 includes 14 nozzles 8 belonging to the triangular region 81 and two nozzles 8 belonging to the first region 83*a* not overlapped with the nozzles 8 belonging to the triangular region 81. These 16 nozzles 8 are arranged in the main-scanning direction in such a manner that at least one or more of the nozzles 8 belonging to triangular region 81 and the nozzles 8 belonging to the first region 83*a* not overlapped with the nozzles 8 belonging to the triangular region 81 are mutually held therebetween.

More specifically, as shown in FIG. 10, two nozzles 8 (the nozzles shown by white circles) belonging to the first region 83*a* not overlapped with the nozzles 8 belonging to the triangular region 81 hold therebetween seven nozzles 8 belonging to the triangular region 81 in the main-scanning direction. Further, these two nozzles 8 belonging to the first region 83*a* not overlapped with the nozzles 8 belonging to the triangular region 81 are held at the band region T1 respectively by the first nozzle 8 and the third nozzle 8 and by the ninth nozzle 8 and the eleventh nozzle 8 on the left in FIG. 10, among these nozzles 8 belonging to the triangular region 81.

The band region T2 includes 12 nozzles a belonging to the triangular region 81 and tour nozzles 8 belonging to the first region 83*a* not overlapped with the nozzles 8 belonging to the triangular region 81. The band region T3 includes 10 nozzles 8 belonging to the triangular region 81 and six nozzles 8 belonging to the first region 83*a* not overlapped with the nozzles 8 belonging to the triangular region 81. The 16 nozzles 8 at each of the band regions T2, T3 are also arranged in the main scanning direction in such a manner that at least one or more of the nozzles 8 belonging to the triangular region 81 and the nozzles 8 belonging to the first region 83*a* not overlapped with the nozzles 8 belonging to the triangular region 81 are mutually held therebetween.

The band region T4 includes eight nozzles 8 belonging to the triangular region 81 and eight nozzles 8 belonging to the first region 83*a* not overlapped with the nozzles 8 belonging to the triangular region 81. These 16 nozzles 8 are arranged alternately in the main-scanning direction in such a manner that one nozzle 8 belonging to the triangular regions 81 and one nozzle 8 belonging to the first region 83*a* not overlapped with the nozzle 8 belonging to the triangular region 81 are held therebetween.

The band region T5 includes six nozzles 8 belonging to the triangular region 81 and 10 nozzles 8 belonging to the first region 83*a* not overlapped with the nozzles 8 belonging to the triangular region 81. The band region T6 includes four nozzles 8 belonging to the triangular region 81 and 12 nozzles 8 belonging to the first region 83*a* not overlapped with the nozzles 8 belonging to the triangular region 81. The 16 nozzles 8 at each of the band regions T5, T6 are also arranged in the main-scanning direction in such a manner that at least one or more of the nozzles 8 belonging to the triangular region 81 and the nozzles 8 belonging to the first region 83*a* not overlapped with the nozzles 8 belonging to the triangular region 81 are mutually held therebetween.

The band region T7 includes two nozzles 8 belonging to the triangular region 81 and 14 nozzles 8 belonging to the first region 83*a* not overlapped with the nozzles 8 belonging to the triangular region 81. These 14 nozzles 8 are also arranged in the main-scanning direction in such a manner that at least one or more of the nozzles 8 belonging to the triangular region 81 and the nozzles 8 belonging to the first region 83*a* not overlapped with the nozzles 8 belonging to the triangular region 81 are mutually held therebetween. The band region T8 includes one nozzle 8 belonging to the triangular region 81 and 15 nozzles 8 belonging to the first region 83*a* not overlapped with the nozzles 8 belonging to the triangular region 81.

As described above, at the band regions T1 to T8, the 16 nozzles 8 in which at least one or more of the nozzles 8 belonging to the triangular region 81 and the nozzles 8 belonging to the first region 83*a* not overlapped with the nozzles 8 belonging to the triangular region 81 are respectively included are arranged apart at a distance corresponding to 600 dpi in the main-scanning direction, and the nozzles 8 belonging to the triangular region 81 and the nozzles 8 belonging to the first region 83*a* not overlapped with the nozzles 8 belonging to the triangular region 81 constitute a complementary relationship.

Further, among the eight band regions T1 to T8, at the band regions T1 to T3 on the side of the first region 83*a* (the rectangular region 83) across the band regions T4 and T5 assumed to be at the center of the triangular region 81 in the main-scanning direction, the nozzles are arranged in such a manner that at least one or more of the nozzles 8 belonging to the triangular region 81 and the nozzles 8 belonging to the first region 83*a* not overlapped with the nozzles 8 belonging to the triangular region 81 are mutually held therebetween.

On the other hand, among the band regions T6 to T8 on the side opposite the first region 83*a*, at the band regions T6 and T7, as described above, the nozzles are arranged in such a manner that at least one or more of the nozzles 8 belonging to the triangular region 81 and the nozzles 8 belonging to the first region 83*a* not overlapped with the nozzles 8 belonging to the triangular region 81 are mutually held therebetween. Therefore, among the band regions T1 to T8, many of the band regions T1 to T7 have a part where the nozzles 8 belonging to the triangular region 81 are held between the nozzles 8 belonging to the first region 83*a* not overlapped with the nozzles 8 belonging to the triangular region 8S, by which a difference in color tone is made less conspicuous.

In addition, since only one of the nozzles 8 belonging to the triangular region 81 is included at the band region T8, no part is formed where the nozzles 8 belonging to the triangular region 81 and the nozzles 8 belonging to the first region 83*a* not overlapped with the nozzles 8 belonging to the triangular region 81 are mutually held therebetween. However, the nozzles 8 belonging to the triangular region 81 included at the band region T8 are held in the main-scanning direction between the nozzles 8 belonging to the first region 83*a* not overlapped with the nozzles 8 belonging to the triangular region 81 included at the band regions T7 and T8.

Further, FIG. 9 shows a plurality of band regions U1 to U8 having a width (677.3 μm) corresponding to 37.5 dpi in the main-scanning direction and extending in the sub-scanning direction at a region where the first region 83*a* of one ink-jet head 2*a* belonging to one head set 1 and the triangular region 82 of the other of the nozzle group 2*b* are overlapped. They are shown sequentially from the left to the right in FIG. 9. Each of the band regions U1 to U8 also includes at least one or more of the ink-ejecting nozzles 8 belonging to the triangular region 82 and the first region 83*a* overlapped therewith, respectively, with a total of 16 ink-ejecting nozzles 8 included. All of these 16 nozzles 8 belong to different nozzle rows 75.

In addition, at the band regions U1 to U8, where nozzles 8 from which no ink is ejected, that is, the nozzles 8 belonging to the first region 83*a* overlapped with the nozzles 8 belonging to the triangular region 82 are included, the total number of the nozzles are changed for each of the band regions U1 to U8. However, where nozzles 8 from which ink is ejected, that is, only the nozzles 8 belonging to the triangular region 82 and the nozzles 8 belonging to the first region 83*a* not overlapped with these nozzles 8 are counted, a total of 16 nozzles 8 are included at each of the band regions U1 to U8.

As shown in FIG. 11, these 16 ink-ejecting nozzles 8 included at each of the eight band regions U1 to U8 are projected on a straight line extending in the main-scanning direction to give projective points. These projective points are arranged on the straight line at equal intervals, and the intervals are equal to a distance (42.3 μm) corresponding to 600 dpi, which is the resolution on printing. In other words, all the nozzles 8 constituting the triangular region 82 and the first region 83*a* that are overlapped, are arranged apart at a distance corresponding to 600 dpi in the main-scanning direction.

As shown in FIG. 11, when consideration is given only to the points projected from the nozzles 8 belonging to the triangular region 82 (black triangles), as with the nozzles 8 belonging to the triangular region 81 described above, the nozzles 8 belonging to the triangular region 82 are arranged apart in the main-scanning direction but not arranged at equal intervals apart at a distance corresponding to 600 dpi. Further, since the white circles and black triangles are both points projected from the nozzles 8 belonging to the first region 83*a*, the nozzles 8 belonging to the first region 83*a* are, as described above, arranged in the main-scanning direction at equal intervals apart at a distance corresponding to 600 dpi even in a single arrangement.

As shown in FIG. 11, the band region U1 includes two nozzles 8 belonging to the triangular region 82 and 14 nozzles 8 belonging to the first region 83*a* not overlapped with the nozzles 8 belonging to the triangular region 82. These 16 nozzles 8 are arranged in the main-scanning direction in such a manner that at least one or more of the nozzles 8 belonging to triangular region 82 and the nozzles 8 belonging to the first region 83*a* not overlapped with the nozzles 8 belonging to the triangular region 82 are mutually held therebetween.

More specifically, as shown in FIG. 11, two nozzles 8 (black triangles) belonging to the triangular region 82 hold therebetween in the main-scanning direction seven nozzles 8 belonging to the first region 83*a* not overlapped with the triangular region 82. Further, the two nozzles a belonging to the triangular region 82 are held at the band region U1 respectively by the first nozzle 8 and the third nozzle 8 and by the ninth nozzle 8 and the eleventh nozzle 8 on the left in FIG. 10, among these nozzles 8 belonging to the first region 83*a* not overlapped with the triangular region 82.

The band region U2 includes four nozzles 8 belonging to the triangular region 82 and 12 nozzles 8 belonging to the first region 83*a* not overlapped with the nozzles 8 belonging to the triangular region 82. The band region U3 includes six nozzles 8 belonging to the triangular region 82 and 10 nozzles 8 belonging to the first region 83*a* not overlapped with the nozzles 8 belonging to the triangular region 82. These 16 nozzles 8 at each of the band regions U2, U3 are also arranged in the main-scanning direction in such a manner that at least one or more of the nozzles 8 belonging to the triangular region 82 and the nozzles 8 belonging to the first region 83*a* not overlapped with the nozzles 8 belonging to the triangular region 82 are mutually held therebetween.

The band region U4 includes eight nozzles 8 belonging to the triangular region 82 and eight nozzles 8 belonging to the first region 83*a* not overlapped with the nozzles 8 belonging to the triangular region 82. These 16 nozzles 8 are arranged alternately in the main-scanning direction in such a manner that one nozzle 8 belonging to the triangular regions 82 and one nozzle 8 belonging to the first region 83*a* not overlapped with the nozzle 8 belonging to the triangular region 82 are held therebetween.

The band region U5 includes 10 nozzles 8 belonging to the triangular region 82 and six nozzles 8 belonging to the first region 83*a* not overlapped with the nozzles a belonging to the triangular region 82. The band region U6 includes 12 nozzles 8 belonging to the triangular region 82 and four nozzles 8 belonging to the first region 83*a* not overlapped with the nozzles 8 belonging to the triangular region 82. These 16 nozzles 8 at each of the band regions U5, U6 are also arranged in the main-scanning direction in such a manner that at least one or more of the nozzles 8 belonging to the triangular region 82 and the nozzles 8 belonging to the first region 83*a* not overlapped with the nozzles 8 belonging to the triangular region 82 are mutually held therebetween.

The band region U7 includes 14 nozzles 8 belonging to the triangular region 82 and two nozzles 8 belonging to the first region 83*a* not overlapped with the nozzles 8 belonging to the triangular region 82. These 16 nozzles 8 are also arranged in the main-scanning direction in such a manner that at least one or more of the nozzles 8 belonging to the triangular region 82 and the nozzles 8 belonging to the first region 83*a* not overlapped with the nozzles 8 belonging to the triangular region 82 are mutually held therebetween. The band region U8 includes 15 nozzles 8 belonging to the triangular region 82 and one nozzle 8 belonging to the first region 83*a* not overlapped with the nozzle 8 belonging to the triangular region 82.

As described above, at the band regions U1 to U8, 16 nozzles 8 in which at least one or more of the nozzles 8 belonging to the triangular region 82 and the nozzles 8 belonging to the first region 83*a* not overlapped with the nozzles 8 belonging to the triangular region 82 are respectively included are arranged apart at a distance corresponding to 600 dpi in the main-scanning direction, and the nozzles 8 belonging to the triangular region 82 and the nozzles 8 belonging to the first region 83*a* not overlapped with the nozzles 8 belonging to the triangular region 82 constitute a complementary relationship.

Further, among the eight band regions U1 to U8, at the band regions U1 to U3 on the side opposite the first region 83*a* (the rectangular region 83) across the band regions U4 and U5 assumed to be at the center of the triangular region 82 in the main-scanning direction, the nozzles are arranged in such a manner that at least one or more of the nozzles 8 belonging to the triangular region 82 and the nozzles 8 belonging to the first region 83*a* not overlapped with the nozzles 8 belonging to the triangular region 82 are mutually held therebetween.

On the other hand, among the band regions U6 to U8 on the side of the first region 83*a*, at the band regions U6 and U7, as described above, the nozzles are arranged in such a manner that at least one or more of the nozzles 8 belonging to the triangular region 82 and the nozzles 8 belonging to the first region 83*a* not overlapped with the nozzles 8 belonging to the triangular region 82 are mutually held therebetween. Therefore, among the band regions U1 to U8, many of the band regions U1 to U7 have a part where the nozzles 8 belonging to the triangular region 82 are held between the nozzles 8 belonging to the first region 83*a* not overlapped with the nozzles 8 belonging to the triangular region 82, thereby the difference in color tone is made less conspicuous.

In addition, since only one of the nozzles 8 belonging to the first region 83*a* not overlapped with the nozzle 8 belonging to the triangular region 82 is included at the band region U8, no part is formed where the nozzles 8 belonging to the triangular region 82 and the nozzles 8 belonging to the first region 83*a* not overlapped with the nozzles 8 belonging to the triangular region 82 are mutually held therebetween. However, the nozzles 8 belonging to the first region 83*a* not overlapped with the nozzles 8 belonging to the triangular region 82 included at the band region U8 are held in the main-scanning direction between the nozzles 8 belonging to the triangular region 82 included at the band regions U7 and U8.

As described above, at a region where the triangular region 81 and the first and the second regions 83*a*, 83*b* of the rectangular region 83 of the nozzle group 71 of one ink-jet head 2*a* are overlapped with the triangular region 82 and the first and the second regions 83*a*, 83*b* of the nozzle group 74 of the rectangular region 83 of the other ink-jet head 2*b* in the sub-scanning direction, or inside a range covering the band regions T1 to T8, the band region S and the band regions U1 to U8, the nozzles 8 belonging to the nozzle groups 71, 74 are arranged apart at a distance corresponding to 600 dpi in the main-scanning direction. Therefore, it is possible to make a continuous printing over the entire width of one ink-jet head 2*a* and that of the other ink-jet head 2*b* in the main-scanning direction.

Thereby, a net width at which eight nozzle groups 71 to 74 of two ink-jet heads 2*a* and 2*b* belonging to the head set 1 can make a continuous printing is, as described previously, substantially equal to a length obtained by subtracting widths of the triangular region 81 of the nozzle group 71 and the triangular region 82 of the nozzle group 74, the nozzle groups being at the outermost positions in the main-scanning direction, from a width in the main-scanning direction of the eight nozzle groups 71 to 74 belonging to the head set 1.

In the thus constituted head set 1, an actuator unit 21 is appropriately driven according to the conveyance of sheets, by which an image having the resolution of 600 dpi can be formed at the printing width of two ink-jet heads 2*a* and 2*b* in the main-scanning direction.

Returning to FIG. 4, a pressure chamber group 9 made up of multiple pressure chambers 10 is formed inside an attached range of the actuator unit 21. The pressure chamber group 9 is formed in a trapezoid shape, which is substantially equal in size to the attached range of the actuator unit 21. One pressure chamber group 9 is provided for each of the actuator units 21.

As apparent from FIG. 4, each of the pressure chambers 10 belonging to the pressure chamber group 9 is communicatively connected to a nozzle 8 at one end of the longer diagonal line thereof and also communicatively connected via an aperture 12 to a sub manifold flow path 55*a* at the other end of the longer diagonal line. As will be described later, an individual electrode 35 (refer to FIG. 12 and FIG. 13) substantially rhomboidal, when viewed from above, and slightly smaller than the pressure chamber 10 is arrayed on the actuator unit 21 in a matrix-like manner so as to face the pressure chamber 10. In addition, in FIG. 4, for easy understanding of the drawing, the nozzle 8, pressure chamber 10, aperture 12 and the like on the flow path unit 7, which should be depicted by the broken line, are actually depicted by the solid line.

The pressure chamber 10 is adjacently arranged in a matrix-like manner in zigzag in two directions of the main-scanning direction and direction C. The shorter diagonal line of the pressure chamber 10 is parallel to the main-scanning direction. A direction parallel to one oblique line of the pressure chamber 10 is such that an angle formed with the main-scanning direction is an obtuse angle θ and parallel to the direction C. Then, both acute angle portions of the pressure chamber 10 are located between two different pressure chambers which are adjacent.

The pressure chamber 10, which is adjacently arranged in a matrix-like manner in two directions of the main-scanning direction and direction C, is spaced at a distance corresponding to 37.5, dpi along the main-scanning direction. Further, 16 units of the pressure chamber 10 are arranged in the direction C inside a region facing one actuator unit 21.

Multiple pressure chambers 10 arranged in a matrix-like manner form a plurality of pressure chamber rows 11 along the main-scanning direction. The pressure chamber rows 11 are divided into a first pressure chamber row 11*a*, a second pressure chamber row 11*b*, a third pressure chamber row 11*c* and a fourth pressure chamber row 11*d*, when viewed in a direction orthogonal to the paper space in FIG. 4, depending on a relative position with respect to the sub manifold flow path 55*a*. These first to fourth pressure chamber rows 11*a* to 11*d* are arranged periodically by every four units in the order of 11*c*→11*d*→11*a*→11*b*→11*c*→11*d*→ . . . →11*b* from the upper side to the lower side of the actuator unit 21.

At the pressure chamber 10*a* constituting the first pressure chamber row 11*a* and the pressure chamber 10*b* constituting the second pressure chamber row 11*b*, the nozzles 8 are located eccentrically below the paper space in FIG. 4, when viewed from a direction orthogonal to the paper space in FIG. 4. Then, the nozzles 8 face the vicinity of the lower ends of the pressure chambers 10 respectively corresponding thereto.

On the other hand, at the pressure chamber 10*c* constituting the third pressure chamber row 11*c* and the pressure chamber 10*d* constituting the fourth pressure chamber row 11*d*, the nozzles 8 are located eccentrically above the paper space in FIG. 4, when viewed from a direction orthogonal to the paper space in FIG. 4. Then, the nozzles 8 face the vicinity of the upper ends of the pressure chambers 10 respectively corresponding thereto.

In the first and the fourth pressure chamber rows 11*a*, 11*d*, the pressure chambers 10*a* and 10*d* are overlapped with the sub manifold flow path 55*a* in more than half of the region, when viewed from a direction orthogonal to the paper space in FIG. 4. In the second and the third pressure chamber rows 11*b*, 11*c*, the pressure chambers 10*b* and 10*c* are not overlapped with the sub manifold flow path 5*a* substantially in the entire region, when viewed from a direction orthogonal to the paper space in FIG. 4. Therefore, the sub manifold flow path 55*a* can be widened to the greatest possible extent to smoothly supply ink to each of the pressure chambers 10, while the pressure chambers 10 belonging to any of the pressure chamber rows 11 are kept so that the nozzles 8 communicatively connecting thereto are not overlapped with the sub manifold flow path 55*a* as well.

Inside a region facing the actuator unit 21, the pressure chambers 10 are arranged at equal intervals in a matrix-like manner respectively in the main-scanning direction, sub-scanning direction and direction C. On the other hand, the nozzles 8 are, as described above, arranged so as to avoid the sub manifold flow path 55*a* and located differently with respect to the pressure chamber 10, depending on the upper or lower position across the sub manifold flow path 55*a*. Therefore, the nozzles 8 are arranged at equal intervals in the main-scanning direction and in a matrix-like manner as a whole.

Next, a description will be given of a constitution of the actuator unit 21. Multiple individual electrodes 35 are arranged on the actuator unit 21 in a matrix-like manner in the same pattern as the pressure chambers 10. Each of the individual electrodes 35 is arranged at a position facing the pressure chamber 10, when viewed from above.

Figure 12:
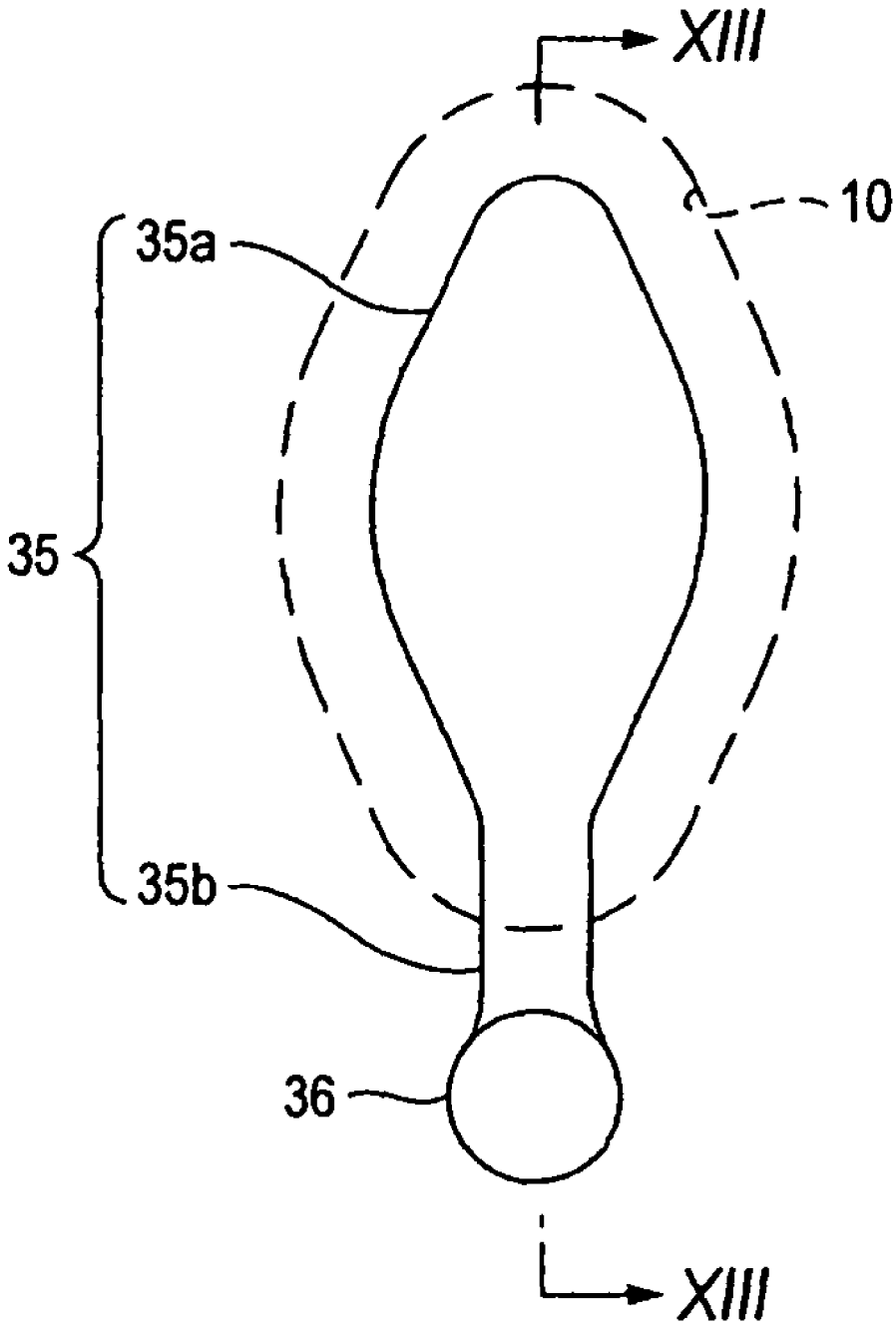
FIG. 12 is a plan view of an individual electrode.

FIG. 12 is a plan view of the individual electrode 35. As shown in FIG. 12, the individual electrode 35 is constituted with a main electrode region 35*a* arranged at a position facing the pressure chamber 10 and accommodated inside the pressure chamber 10, when viewed from above, and an auxiliary electrode region 35*b* connected to the main electrode region 35*a* and also arranged at a position facing the outside of the pressure chamber 10. Each of the individual electrodes 35 has a thickness of approximately 1 μm.

Figure 13:
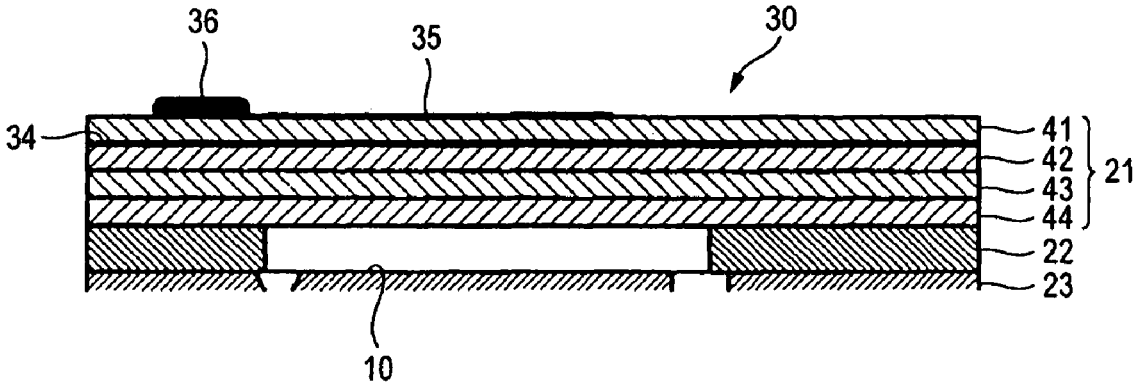
FIG. 13 is a cross sectional view taken along the XIII-XIII line shown in FIG. 12.

FIG. 13 is a cross sectional view taken along the line of XIII-XIII in FIG. 12. As shown in FIG. 12, an actuator unit 21 includes four piezoelectric sheets 41, 42, 43, and 44, each of which is substantially equal in thickness. These piezoelectric sheets 41 to 44 are arranged astride multiple pressure chambers 10 formed inside one ink ejecting region in the head main body 3. The piezoelectric sheets 41 to 44 are made of a ceramic material based on lead zirconate titanate (PZT) high in dielectric performance.

As shown in FIG. 12, the main electrode region 35*a* of the individual electrode 35 formed on the uppermost piezoelectric sheet 41 is substantially rhomboidal, when viewed from above, which is almost similar to the pressure chamber 10. In other words, each part of the rhomboid is formed in a smooth curve (circular arc). A lower acute angle portion of the substantially rhomboidal main electrode region 35*a* is elongated and connected to the auxiliary electrode region 35*b* facing the outside of the pressure chamber 10. A circular land portion 36 electrically connected to the individual electrode 35 is formed at the leading end of the auxiliary electrode region 35*b*.

As shown in FIG. 13, the land portion 36 faces a region where no pressure chamber 10 is formed on a cavity plate 22. The land portion 36 is made of gold containing glass frit, for example, and, as shown in FIG. 12, formed on the surface of the elongated portion at the auxiliary electrode region 35*b*. The land portion 36 is electrically joined to a contact point installed on a flexible printed circuit (FPC) (not illustrated). A controller 150 supplies voltage pulse through the FPC to the individual electrode 35, as will be described later.

A common electrode 34, which is similar to the piezoelectric sheet 41 in outer shape and has a thickness of approximately 2 μm, is placed between the uppermost piezoelectric sheet 41 and the piezoelectric sheet 42 below thereof. The individual electrode 35 and the common electrode 34 are both made of, for example, a metal material based on Ag—Pd.

The common electrode 34 is grounded at a region (not illustrated) and kept equally at a certain electric potential in regions corresponding to all the pressure chambers 10, or at a ground electric potential in the first exemplary embodiment. Further, the individual electrodes 35 are connected to a driver IC 180 (refer to FIG. 14) via the FPC containing a different independent lead wire for each of the individual electrodes 35 and a land portion 36 in such a manner that the electric potential can be controlled by each individual electrode corresponding to each of the pressure chambers 10.

As will be described later, a predetermined voltage pulse is supplied selectively to the individual electrodes 35, by which pressure is applied to ink inside the pressure chambers 10 corresponding to the individual electrodes 35. Thereby, ink is ejected from the corresponding nozzles 8 through individual ink flow paths 32. In other words, a portion facing each of the pressure chambers 10 at the actuator unit 21 is equivalent to an individual piezoelectric actuator 30 corresponding to each of the pressure chambers 10 and the nozzles 8. Specifically, an actuator having the structure given in FIG. 13 as a unit structure is fabricated for each of the pressure chambers 10 inside a laminated body made up of four sheets of piezoelectric layers, thereby constituting the actuator unit 21.

Figure 14:
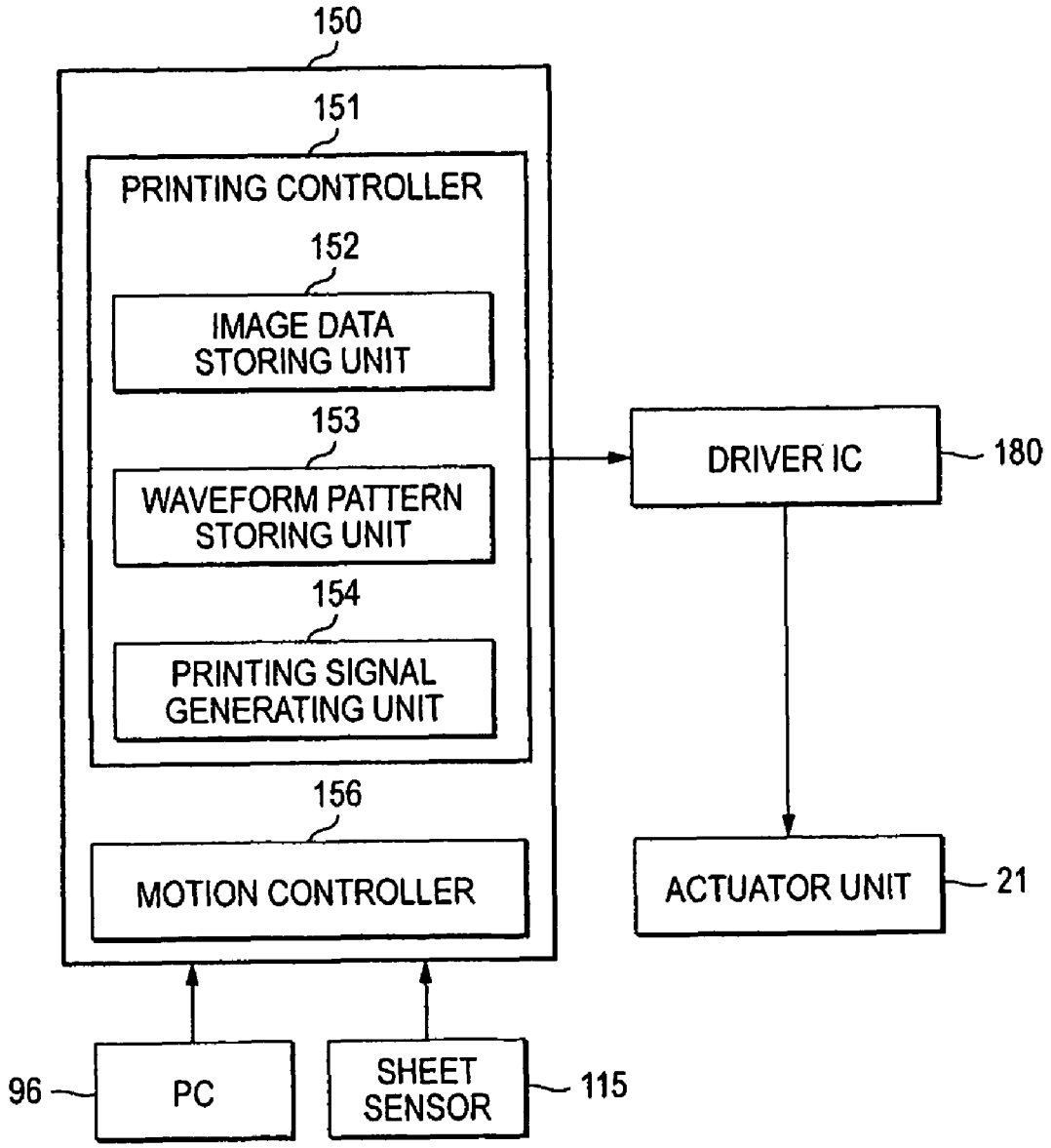
FIG. 14 is a drawing for explaining a controller of the ink-jet printer shown in FIG. 1.

Hereinafter, a description will be given of controlling the actuator unit 21. FIG. 14 is a drawing for explaining a controller 150 mounted on the printer given in FIG. 1. In order to control the actuator unit 21, a printer 1 is provided with the controller 150 and a driver IC 180. In addition, the printer 1 is provided with an arithmetic processing unit or a central processing unit (CPU), a read only memory (ROM) for storing programs executed by the CPU and data used for the programs and a random access memory (RAM) for temporarily storing data at the time of execution of the programs. These components constitute the controller 150 having functions to be described hereinafter.

As shown in FIG. 14, the controller 150 is provided with a printing controller 151 and a motion controller 156. The motion controller 156 drives and controls a sheet feeding mechanism 111 and a conveying mechanism 110 on the basis of data on printing sent from a PC 99 and the like. The printing controller 151 is provided with an image data storing unit 152, a waveform pattern storing unit 153 and a printing signal generating unit 154. The image data storing unit 152 stores image data on printing sent from the PC 99 and the like.

The waveform pattern storing unit 153 stores waveform data corresponding to a plurality of ejection pulse waveforms. Each of the ejection pulse waveforms corresponds to a basic waveform according to the tone of an image and the like. A voltage pulse signal corresponding to the above-described waveform is supplied via a driver IC 80 to the individual electrodes 35, by which ink is ejected from the ink-jet head 2 at a quantity in response to the respective tones and the like.

The printing signal generating unit 154 generates serial printing data on the basis of image data stored at the image data storing unit 152. Such printing data corresponds to any of the data corresponding to a plurality of ejection pulse waveforms stored at the waveform pattern storing unit 153, or it is data for giving instructions of supplying each ejection pulse waveform to each of the individual electrodes 35 at a predetermined timing. The printing signal generating unit 154 prepares printing data according to the timing, waveforms and individual electrodes corresponding to image data on the basis of the image data stored at the image data storing unit 152. Then, the printing signal generating unit 154 outputs the thus generated printing data to the driver IC 180.

In addition, upon generation of printing data at the printing signal generating unit 154, it is determined which nozzle 8 ejects ink, and the printing data is generated on the basis of this determination. In the first exemplary embodiment, such determination is made at the printing signal generating unit 154 that no ejection pulse waveform is supplied at any timing to: individual electrodes 35 corresponding to the nozzles 8 belonging to the triangular region 81 of the nozzle group 71 and the triangular region 82 of the nozzle group 74, the nozzle groups, among eight nozzle groups 71 to 74 belonging to each of the head sets 1, being at the outermost positions in the main-scanning direction; individual electrodes 35 corresponding to the nozzles 8 belonging to the first region 83*a* of one ink-jet head 2*a* overlapped in the sub-scanning direction with the nozzles 8 belonging to the triangular region 82 of the nozzle group 74 of the other ink-jet head 2*b*; or individual electrodes 35 corresponding to the nozzles 8 belonging to the first and the second regions 83*a*, 83*b* of the other ink-jet head 2*b* overlapped in the sub-scanning direction with the nozzles 8 belonging to the triangular region 81 and the second region 83*b* of the nozzle group 71 of one ink-jet head 2*a*.

As described above, a pulse waveform at such an extent as to vibrate the meniscus of ink may be supplied to the nozzles 8 to which no ejection pulse waveform is supplied, in view of preventing ink of the nozzles 8 from increased viscosity and drying.

Thereby, it is possible to attain easy control that no ink is ejected from the nozzles a overlapped with the nozzles 8 belonging to the triangular region 82 of the nozzle group 74 of the other ink-jet head 2*b*, among a plurality of the nozzles 8 constituting the rectangular region 83 of the nozzle group 71 of one ink-jet head 2*a*, or from the nozzles 8 overlapped with the nozzles 8 belonging to the triangular region 81 and the nozzles 8 belonging to the first region 83*a* of the nozzle group 71 of one ink-jet head 2*a*, among a plurality of the nozzles 8 constituting the rectangular region 83 of the nozzle group 74 of the other ink-jet head 2*b*. Further, at the band regions T1 to T8 and U1 to U8, ink is ejected from the nozzles 8 belonging to the triangular regions 81, 82. Therefore, if a difference is found in color tone on an image formed by one and the other ink-jet heads 2*a* and 2*b*, the color tone is gradually changed at the band regions T1 to T8 and U1 to U8, thus making the difference in color tone less conspicuous at the border part thereof.

The driver IC 80 is mounted for each of the actuator units 21 and provided with a shift register, a multiplexer and a drive butter (none or them is illustrated).

The shift register converts serial printing data outputted from the printing signal generating unit 154 to parallel data. In other words, the shift register outputs individual data for a piezoelectric actuator 30 corresponding to each of the pressure chambers 10 and the nozzles 8 according to the instructions of the printing data.

The multiplexer selects appropriate data from waveform data stored at the waveform pattern storing unit 153 on the basis of each data outputted from the shift register. Then, the multiplexer outputs the thus selected data to the drive buffer.

The drive buffer generates an ejection voltage pulse signal having a predetermined level on the basis of waveform data outputted from the multiplexer. Then, the drive buffer supplies the ejection voltage pulse signal via the FPC to individual electrodes 35 corresponding to each of the piezoelectric actuators 30.

Next, a description will be given of actuation of the piezoelectric actuator 30. Polarization of the piezoelectric sheet 41 at the actuator unit 21 is oriented in a direction of the thickness. In other words, the piezoelectric actuator 30 is of a so-called unimorph constitution in which the piezoelectric sheet 41 is given as a layer having an activated part and the three piezoelectric sheets 42 to 44 are given as a non-activated layer.

A predetermined ejection voltage pulse is selectively supplied to individual electrodes 35 from the driver IC 180, by which the individual electrodes 35 are given a predetermined positive or negative electric potential. Then, an electric field application portion held between the electrodes in the piezoelectric sheet 41 acts as an activated part (pressure generating unit), shrinking at a right angle with respect to the polarization direction due to a piezoelectric transversal effect, for example, when the electric field and the polarization take place in the same direction.

On the other hand, the three piezoelectric sheets 42 to 44 receive no electric field from outside and, as a result, hardly function as an activated part. In other words, in the piezoelectric sheet 41, a part held between the main electrode region 35*a* and the common electrode 34 mainly shrinks at a right angle with respect to the polarization direction due to the piezoelectric transversal effect. Other piezoelectric sheets 42 to 44 regulate the displacement. Thereby, the piezoelectric sheets 41 to 44 are as a whole deformed in such a manner as to be convex to a non-activated side, that is, to the pressure chamber side. As a result, the pressure chamber 10 is decreased in volume and ink is increased in pressure, thereby ejected from nozzles 8. Thereafter, the individual electrodes 35 are returned to the same electric potential as that of the common electrode 34, by which the piezoelectric sheets 41 to 44 assume an original shape and a pressure chamber 10 is also returned to the original volume. Then, the ink is sucked from the sub manifold flow path 55*a*.

In addition, there is another driving method in which the individual electrode 35 is made in advance different in electric potential from the common electrode 34, on each request for ejection, the individual electrode 35 is made once equal in electric potential to the common electrode 34, and the individual electrode 35 is thereafter made again different in electric potential from the common electrode 34 at a predetermined timing. In this instance, at a timing when the individual electrode 35 is made equal in electric potential to the common electrode 34, the piezoelectric sheets 41 to 44 return to their original shape, by which the pressure chamber 10 is made greater in volume than at the initial state (a state in which both electrodes are different in electric potential), thus sucking ink from the sub manifold flow path 55*a* into the pressure chamber 10. Thereafter, again, at a timing when the individual electrode 35 is made different in electric potential from the common electrode 34, the piezoelectric sheets 41 to 44 are deformed so as to be convex toward the pressure chamber 10, and the pressure chamber 10 is decreased in volume to increase the pressure to ink, by which the ink is ejected.

Example of Printing Operation

Again, returning to FIG. 4, the band region S given in FIG. 4 is the band region S the same as that given in FIG. 7. Any row of 16 pressure chamber rows 11*a* to 11*d* has only one nozzle 8 at the band region S. Thereby, it is apparent that each of the pressure chamber rows 11*a* to 11*d* corresponds to the first nozzle row 75*a* to the sixteenth nozzle row 75*p* given in FIG. 7. In addition, since the head main body 3 is viewed from below in FIG. 7, the pressure chamber row 11 corresponding to the nozzle row 75 is placed upside down.

A description will be given of a case where, for example, a straight line extending in the main-scanning direction is printed at the resolution of 600 dpi. A brief description will be given by referring to FIG. 4 of a reference example (not illustrated) where the nozzles 8 (and pressure chambers 10) are arrayed so as to form mutually adjacent ink dots from the lowermost one to the upper ones sequentially.

In this example, the ejection of ink is started from a nozzle 8 at the pressure chamber row located most upstream in the conveyance direction in response to the conveyance of a sheet. Then, ink is ejected by selecting a nozzle 8 belonging to a pressure chamber row adjacent sequentially to the upper side. Thereby, dots are formed adjacently at the interval of 600 dpi in the main-scanning direction. Finally, a straight line is depicted extending in the main-scanning direction at a resolution of 600 dpi as a whole.

In the first exemplary embodiment, the ejection of ink is started from a nozzle 8 at the pressure chamber row 11*b* located at the lowermost position in FIG. 4, and ink is ejected by selecting a nozzle 8 communicatively connected to a pressure chamber adjacent sequentially to the upper side according to the conveyance of a sheet. In this instance, since no nozzle is disposed at the same position in the main-scanning direction by each elevation of the pressure chamber row from below to above, dots of ink sequentially formed along the main-scanning direction according to the conveyance of sheets are not evenly spaced at the interval of 600 dpi.

In other words, as shown in FIG. 4, first, ink is ejected from the nozzle (1) communicatively connected to the lowermost pressure chamber row 11*b* in the drawing in response to the conveyance of a sheet, and dot rows are formed on the sheet at the interval corresponding to 37.5 dpi. Thereafter, when a straight-line forming position arrives at the nozzle (9) communicatively connected to the second lowermost pressure chamber row 11*a* according to the conveyance of the sheet, ink is ejected from the nozzle (9). Thereby, a second ink dot is formed at a position displaced in the main-scanning direction only by eight times the interval corresponding to 600 dpi from an initially formed dot position.

Then, when the straight-line forming position arrives at the nozzle (13) communicatively connected to the third lowermost pressure chamber row 11*d* according to the conveyance of a sheet, ink is ejected from the nozzle (13). Thereby, a third ink dot is formed at a position displaced in the main-scanning direction only by 12 times the interval corresponding to 600 dpi from an initially formed dot position. Further, when the straight-line forming position arrives at the nozzle (15) communicatively connected to the fourth lowermost pressure chamber row 11*c* according to the conveyance of the sheet, ink is ejected from the nozzle (15). Thereby, a fourth ink dot is formed at a position displaced in the main-scanning direction only by 14 times the interval corresponding to 600 dpi from an initially formed dot position. Still further, when the straight-line forming position arrives at the nozzle (5) communicatively connected to the fifth lowermost pressure chamber row 11*b* according to the conveyance of the sheet, ink is ejected from the nozzle (5). Thereby, a fifth ink dot is formed at a position displaced in the main-scanning direction only by 4 times the interval corresponding to 600 dpi from an initially formed dot position.

Hereinafter, in the same manner, ink dots are formed by selecting the nozzles 8 communicatively connected to the pressure chambers 10 located sequentially from below to above in the drawing. In this instance, when the nozzle 8 given in FIG. 4 is numbered N, an ink dot is formed at a position displaced in the main-scanning direction only by an interval corresponding to (multiplying factor n=N=1)×(interval corresponding to 600 dpi) from an initially formed dot position. Finally, when the 16 nozzles 8 are completely selected, a space between ink dots formed at the interval corresponding to 37.5 dpi by the lowermost nozzle (1) given in the drawing is jointed by 15 dots formed apart at every interval corresponding to 600 dpi, thereby making it possible to depict a straight line extending in the main-scanning direction at the resolution of 600 dpi as a whole.

In addition, the triangular regions 81 and 82 to which four nozzle groups 71 to 74 are adjacent for each ink-jet head, the triangular region 81 and the first and the second regions 83*a*, 83*b* of the nozzle group 71 of one ink-jet head 2*a* of the head set 1, the triangular region 82 and the first and the second regions 83*a*, 83*b* of the other ink-jet head 2*b* make the above-described complementary relationship in the main-scanning direction, by which printing can be made at the resolution of 600 dpi.

As described above, in printing operations at the rectangular region 83, ink is ejected in the order of (1), (9), (13), (15), (5), (7), (11), (16), (3), (8), (12), (14), (4), (6), (10) and (2) to form an image. However, at a region where the triangular regions 81 and 82 are mutually overlapped, the corresponding nozzle groups are spaced from each other in the sub-scanning direction even in one ink-jet head 2, with the respective intervals kept. Therefore, the printing operations are also conducted, with this spacing being taken into account. Further, at the regions where the triangular region 81 is overlapped with the first region 83*a* and the triangular region 82 is overlapped with the first region 83*a*, even between the two ink-jet heads 2*a* and 2*b*, facing nozzle groups are spaced from each other in the sub-scanning direction, with the respective intervals kept. Therefore, as described above, the printing operations are also conducted, with this spacing taken into account.

In an overlapped region inside one ink-jet head 2, at one band region R (for example, R2), among 16 nozzles 8, (1), (9), (13), (15), (5), (7), (11), (16), (3), (8), (12) and (4) belong to one of the nozzle groups, whereas (14), (6), (10) and (2) belong to the other of the nozzle groups adjacent thereto. At the rectangular region 83, as shown in the above-described printing procedure, according to the conveyance of a sheet, the nozzles 8 eject ink droplets in the order of (1), (9), (13), (15), (5), (7), (11), (16), (3), (8) and (12). The subsequent (14) nozzle 8 belongs to a different nozzle group. Therefore, ink is ejected from the (14) nozzle 8 after the lapse of time in which the sheet is conveyed over a distance obtained by adding a distance spaced between the two nozzle groups to a distance spaced between (12) and (14) at the rectangular region 83. Since the sheet arrives at the (4) nozzle 8 at one of the nozzle groups within this time, the nozzle 8 ejects ink earlier. Thereafter, according to the conveyance of the sheet, ink is ejected in the order of (14), (6), (10) and (2) belonging to the other of the nozzle groups.

Further, at the band region R3 next to the band region R2, (1), (9), (13), (15), (5), (7), (11), (16), (3) and (8) belong to one of the nozzle groups, whereas (12), (14), (4), (6), (10) and (2) belong to the other of the nozzle groups. At this region, after ink is ejected from the (8) nozzle 8, ink is ejected from the (12) nozzle 8 after the lapse of time in which the sheet is conveyed over a distance obtained by adding a distance spaced between the two nozzle groups to a distance spaced between (8) and (12) at the rectangular region 83.

As described so far, at an overlapped region inside one ink-jet head 2, at a timing when the nozzles 8 change in belonging from one of the nozzle groups to the other of the nozzle groups at each of the band regions R, a waiting time takes place in response to a distance spaced between these two nozzle groups. Between the nozzles 8 belonging to a nozzle group adjacent in the main-scanning direction but different in the conveyance direction, if a nozzle 8 is found in the nozzle group on the upstream side (one of the groups) within a time obtained by adding the waiting time to a difference in ejection timing (time difference) at the rectangular region 83, ink is to be ejected earlier from this nozzle 8, which is different from the ejection order at the rectangular region 83.

In the first exemplary embodiment, the band region R including nozzles 8 ejecting ink in a different order from that at the rectangular region 83 alternates with a region where ink is ejected in the same order as that at the rectangular region 83.

The same also applies to a case between two ink-jet heads 2*a* and 2*b*. In other words, even where a region is different at which the triangular region 81 is overlapped with the first region 83*a*, the nozzles 8 belonging to the first region 83*a* not overlapped in the sub-scanning direction with the nozzles 8 belonging to the triangular region 81 are arrayed in the same manner as the nozzles 8 belonging to the triangular region 82, and at a region where the triangular region 82 is overlapped with the first region 83*a* as well, the nozzles 8 belonging to the first region 83*a* not overlapped in the sub-scanning direction with the nozzles 8 belonging to the triangular region 82 are arrayed in the same manner as the nozzles 8 belonging to the triangular region 81.

In this instance, at a region where the ends overlap each other, ink is ejected from the nozzles 8 of the other nozzle group after the lapse of time corresponding to a distance spaced between the ink-jet heads 2*a* and 2*b*. Thereby, an image can be recorded continuously by ink ejected from eight nozzle groups 71 to 74.

As described above, according to the head unit 5 of the first exemplary embodiment, two ink-jet heads 2*a* and 2*b* are combined in such a manner that a printing region in the main-scanning direction has substantially the same printing region as the printing region of a long ink-jet head (that is, substantially the same printing region as a total printing region obtained by adding printing regions of the two ink-jet heads 2*a* and 2*b* in main-scanning direction), thereby eliminating the necessity for manufacturing a single long ink-jet head and also improving the yield.

Further, the second region 83*b* (a portion of the rectangular region 83) of the nozzle group 71 of one ink-jet head 2*a* of the head set 1 is overlapped in the sub-scanning direction with the second region 83*b* (a portion of the rectangular region 83) of the nozzle group 74 of the other ink-jet head 2*b*. Therefore, a white streak resulting from an error in assembly on assembly of one and the other ink-jet heads 2*a* and 2*b* on the holder 4 is less likely to develop on an image when it is printed. In other words, where the rectangular region 83 of one ink-jet head 2*a* is not overlapped partially in the sub-scanning direction with that of the other ink-jet head 2*b*, any slight deviation of these ink-jet heads 2*a* and 2*b* toward a direction apart in the main-scanning direction upon assembly of one and the other ink-jet heads 2*a* and 2*b* on the holder 4 will cause white streaks on an image when it is printed.

Further, the triangular region 81 and the first and the second regions 83*a*, 83*b* of the nozzle group 71 of one ink-jet head 2*a* of the head set 1 are overlapped in the sub-scanning direction with the triangular region 82 and the first and the second regions 83*a*, 83*b* of the nozzle group 74 of the other ink-jet head 2*b*, and also all the nozzles 8 belonging to the thus overlapped triangular regions 81 and 82, the first and the second regions 83*a*, 83*b* are arranged apart at an interval corresponding to 600 dpi in the main-scanning direction. Therefore, any difference in color tone found on an image formed by one and the other of ink-jet heads 2*a* and 2*b* is made less conspicuous on the border part thereof, because the color tone will be changed gradually at the thus overlapped part.

Still further, nozzles 8 respectively belonging to the triangular region 81 of the nozzle group 71 of one ink-jet head 2*a* and the first region 83*a* of the nozzle group 74 of the other ink-jet head 2*b* are distributed at any of the band regions T1 to T8, which makes a difference in color tone less conspicuous. The nozzles 8 respectively belonging to the first region 83*a* of the nozzle group 71 of one ink-jet head 2*a* and the triangular region 82 of the nozzle group 74 of the other ink-jet head 2*b* are distributed at any of the band regions U1 to U8 as well, which makes a difference in color tone less conspicuous.

In addition, in each of the ink-jet heads 2, the nozzle groups 71 to 74 are provided with the triangular regions 81 and 82 on both sides holding the rectangular region 83 between them in the main-scanning direction, and these adjacent triangular regions 81 and 82 are overlapped substantially over the entire region in the sub-scanning direction, and also all the nozzles 8 belonging to the thus overlapped triangular regions 81 and 82 are arranged apart in the main-scanning direction at the interval corresponding to 600 dpi. Thereby, a plurality of the ink-jet heads 2 having a plurality of the nozzle groups 71 to 74 are used to constitute the head unit 5. Further, the four nozzle groups 71 to 74 are arrayed in point symmetry on an ink ejecting face 3*a*, thus making it possible to easily manufacture the ink-jet head 2 having multiple nozzle groups 71 to 74.

As an exemplified variation, when printing data is generated at a printing signal generating unit 154, such determination may be made at the printing signal generating unit 154 that no ejection pulse waveform is supplied at any timing to: individual electrodes 35 corresponding to the nozzles 8 belonging to the triangular region 81 of the nozzle group 71 and the triangular region 82 of the nozzle group 74, the nozzle groups, among eight nozzle groups 71 to 74 belonging to each of the head sets 1, being at the outermost positions in the main-scanning direction; individual electrodes 35 corresponding to the nozzles belonging to the triangular region 81 of the nozzle group 71 of one ink-jet head 2*a*; or individual electrodes 35 corresponding to the nozzles 8 belonging to the triangular region 82 and the second region 83*b* of the nozzle group 74 of the other ink-jet head 2*b*.

In addition, a pulse waveform at such an extent as to vibrate the meniscus of ink formed on nozzles 8 may be supplied to the nozzles 8 in place of supplying an ejection pulse waveform. Thereby, it is possible to prevent increased viscosity of ink at the nozzles 8, which is controlled to eject no ink.

In this instance, inside a range where the nozzle group 71 of one ink-jet head 2*a* is overlapped in the sub-scanning direction with the nozzle group 74 of the other ink-jet head 2*b*, such easy control can be attained that ink is ejected from the nozzles 8 belonging to the first and the second regions 83*a*, 83*b* of the nozzle group 71 and the first region 83*a* of the nozzle group 74.

In addition, in the above-described exemplified variation, no ink is ejected from the nozzles 8 belonging to the triangular region 81 of the nozzle group 71 of one ink-jet head 2*a* and the triangular region 82 of the nozzle 74 of the other ink-jet head 2*b*, thereby eliminating the necessity for installing these triangular regions 81 and 82.

Figure 15:
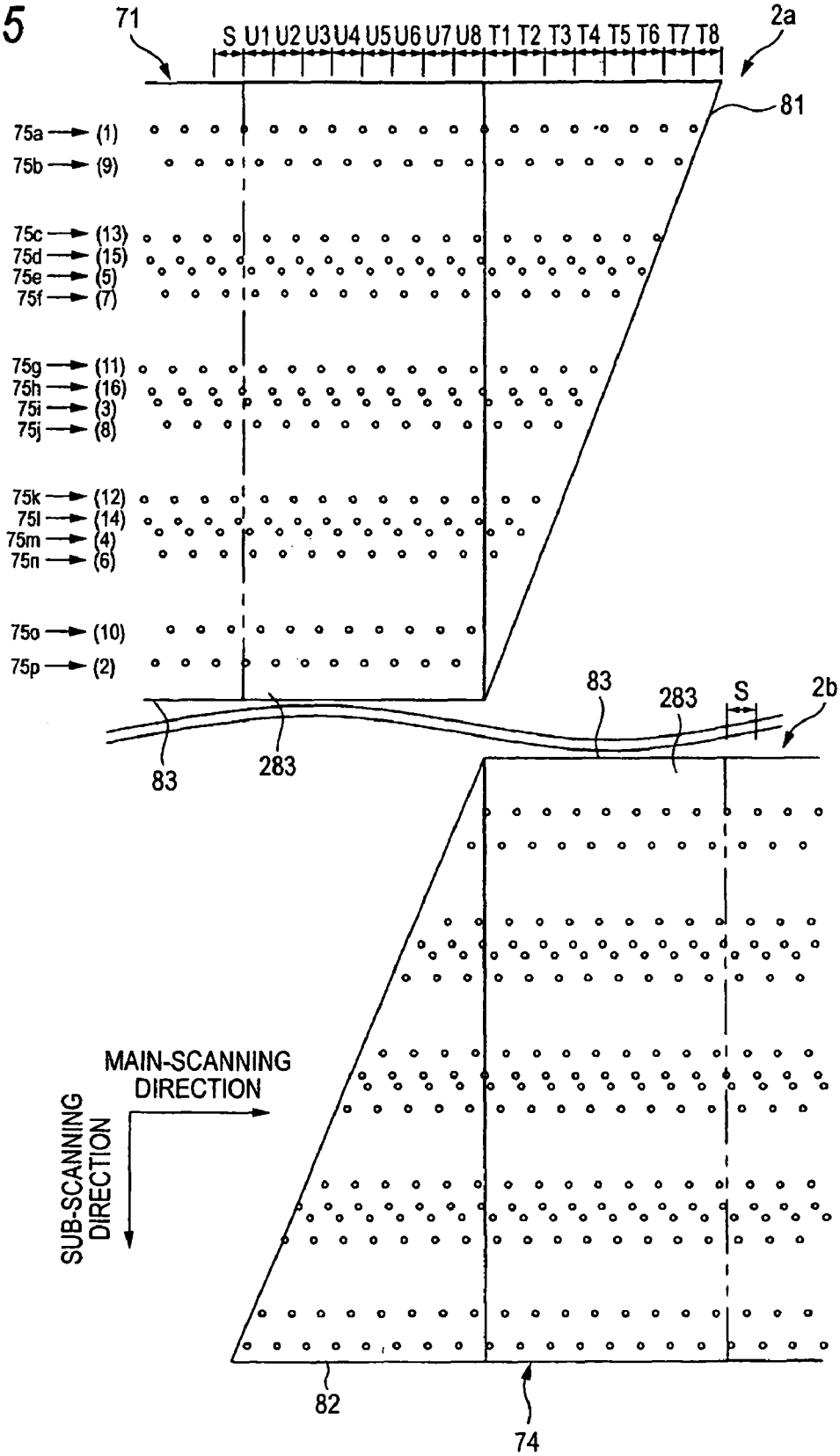
FIG. 15 is a partially enlarged plan view of a head main body of a head set according to a second exemplary embodiment of the present invention when viewed from below.

Next, a description will be given of an ink-jet printer according to a second exemplary embodiment of the present invention by referring to FIG. 15. FIG. 15 is a partially enlarged plan view showing a head main body of the head set of the second exemplary embodiment of the present invention, when viewed from below. In addition, FIG. 15 is also drawn by bringing the nozzle group 71 belonging to one ink-jet head 2*a* closer in the sub-scanning direction to the nozzle group 74 belonging to the other ink-jet head 2*b* for easy understanding of the drawing.

The ink-jet printer of the second exemplary embodiment is similar in constitution to that of the first exemplary embodiment except that a part where the two ink-jet heads 2*a* and 2*b* constituting the head set are overlapped in the sub-scanning direction is different. In addition, the same components as those of the first exemplary embodiment are given the same symbols or numerals, with description omitted here.

As shown in FIG. 15, in the head set of the second exemplary embodiment, one and the other ink-jet heads 2*a* and 2*b* are arranged parallel to each other so that the triangular region 81 of the nozzle group 71 of one ink-jet head 2*a* is overlapped substantially over the entire region in the sub-scanning direction with a portion (region 283) of the rectangular region 83 of the nozzle group 74 of the other ink-jet head 2*b*. Further, the nozzles 8 belonging to the triangular region 81 are overlapped in the sub-scanning direction with the nozzles 8 belonging to the overlapped region 283.

Further, the triangular region 82 of the nozzle group 74 of the other ink-jet head 2*b* is also overlapped substantially over the entire region in the sub-scanning direction with a portion (region 283) of the rectangular region 83 of the nozzle group 71 of one ink-jet head 2*a*. However, the rectangular regions 83 of the nozzle groups 71 and 74 are not overlapped with each other in the sub-scanning direction and arranged in the main-scanning direction continuously without interruption. The nozzles 8 belonging to the triangular region 82 are overlapped in the sub-scanning direction with the nozzles 8 belonging to the thus overlapped region 283.

The region 283 of one and the other ink-jet heads 2*a* and 2*b* is the same in width in the main-scanning direction as the first region 83*a* of the first exemplary embodiment. The nozzles belonging thereto are also arranged in the same manner. Therefore, the band regions T1 to T8 and U1 to U8 shown in FIG. 15 are also the same as those shown in the first exemplary embodiment. In addition, the nozzles 8 included at the band region U8 and the band region T1 are continuously arrayed apart at a distance corresponding to 600 dpi.

Because of the above-described constitution, a length obtained by subtracting widths of the triangular region 81 of the nozzle group 71 and the triangular region 82 of the nozzle group 74, the nozzle groups being at the outermost positions in the main-scanning direction, from a width in the main-scanning direction of eight nozzle groups 71 to 74 belonging to the head set is a length at which printing can be made continuously in the head set of the second exemplary embodiment as well.

A printing signal generating unit included in the controller (control means) of the second exemplary embodiment is substantially similar in control constitution to the first exemplary embodiment but slightly different in determining which nozzle 8 is used to eject ink on generation of printing data. At the printing signal generating unit of the second exemplary embodiment, such determination is made that no ejection pulse waveform is supplied at any timing to: individual electrodes 35 corresponding to the nozzles 8 belonging to the triangular region 81 of the nozzle group 71 and the triangular region 82 of the nozzle group 74, the nozzle groups, among eight nozzle groups 71 to 74 belonging to each of the head sets, being at the outermost positions in the main-scanning direction; individual electrodes 35 corresponding to the nozzles 8 belonging to the region 283 of the nozzle group 71 of one ink-jet head 2*a* overlapped in the sub-scanning direction with the nozzles 8 belonging to the triangular region 82 of the nozzle group 74 of the other ink-jet head 2*b*; or individual electrodes 35 corresponding to the nozzles 8 belonging to the region 283 of the nozzle group 74 of the other ink-jet head 2*b* overlapped in the sub-scanning direction with the nozzles 8 belonging to the triangular region 81 of the nozzle group 71 of one ink-jet head 2*a*.

In this instance, inside a range where the nozzle group 71 of one ink-jet head 2*a* is overlapped in the sub-scanning direction with the nozzle group 74 of the other ink-jet head 2*b*, such easy control can be attained that ink is ejected from the nozzles 8 belonging to the triangular region 81 of the nozzle group 71, the nozzles 8 belonging to the triangular region 82 of the nozzle group 74, and the nozzles 8 belonging to the region 283 not overlapped with the nozzles 8 belonging to the triangular regions 81, 82 of the nozzle groups 71, 74.

As described so far, in the second exemplary embodiment, inside a range where the nozzle group 71 of one ink-jet head 2*a* is overlapped in the sub-scanning direction with the nozzle group 74 of the other ink-jet head 2*b*, that is, at the band regions T1 to T8 and U1 to U8, ink is ejected from the nozzles 8 belonging to the triangular regions 81, 82. Therefore, any difference in color tone found on an image formed by one and the other ink-jet heads 2*a* and 2*b* is made less conspicuous at the border part thereof, because the color tone will be changed gradually at the band regions T1 to T8 and U1 to U8. Further, unlike the first exemplary embodiment, no band region S is included between the band regions T1 to T8 and the band regions U1 to U8, thereby change in color tone is even less conspicuous and looks smooth. In addition, the ink-jet printer of the second exemplary embodiment is also able to provide the same effect, if constituted similarly to the first exemplary embodiment.

As an exemplified variation, when printing data is generated, such determination may be made at the printing signal generating unit that no ejection pulse waveform is supplied at any timing to: individual electrodes 35 corresponding to the nozzles belonging to the triangular region 81 of the nozzle group 71 and the triangular region 82 of the nozzle group 74, the nozzle groups, among eight nozzle groups 71 to 74 belonging to each of the head sets 1, being at the outermost positions in the main-scanning direction; individual electrodes 35 corresponding to the nozzles 8 belonging to the triangular region 81 of the nozzle group 71 of one ink-jet head 2*a*; or individual electrodes 35 corresponding to the nozzles 8 belonging to the triangular region 82 of the nozzle group 74 of the other ink-jet head 2*b*. In addition, in this instance as well, a pulse waveform at such an extent that vibrates the meniscus of ink of the nozzles 8 may be supplied.

In this instance, inside a range where the nozzle group 71 of one ink-jet head 2*a* is overlapped in the sub-scanning direction with the nozzle group 74 of the other ink-jet head 2*b*, such easy control can be attained that ink is ejected from the nozzles 8 belonging to the region 283.

In addition, in the above exemplified variation, no ink is ejected from the nozzles 8 belonging to the triangular region 81 of the nozzle group 71 of one ink-jet head 2*a* and the triangular region 82 of the nozzle group 74 of the other ink-jet head 2*b*, thereby eliminating the necessity for installing the triangular regions 81 and 82.

Figure 16:
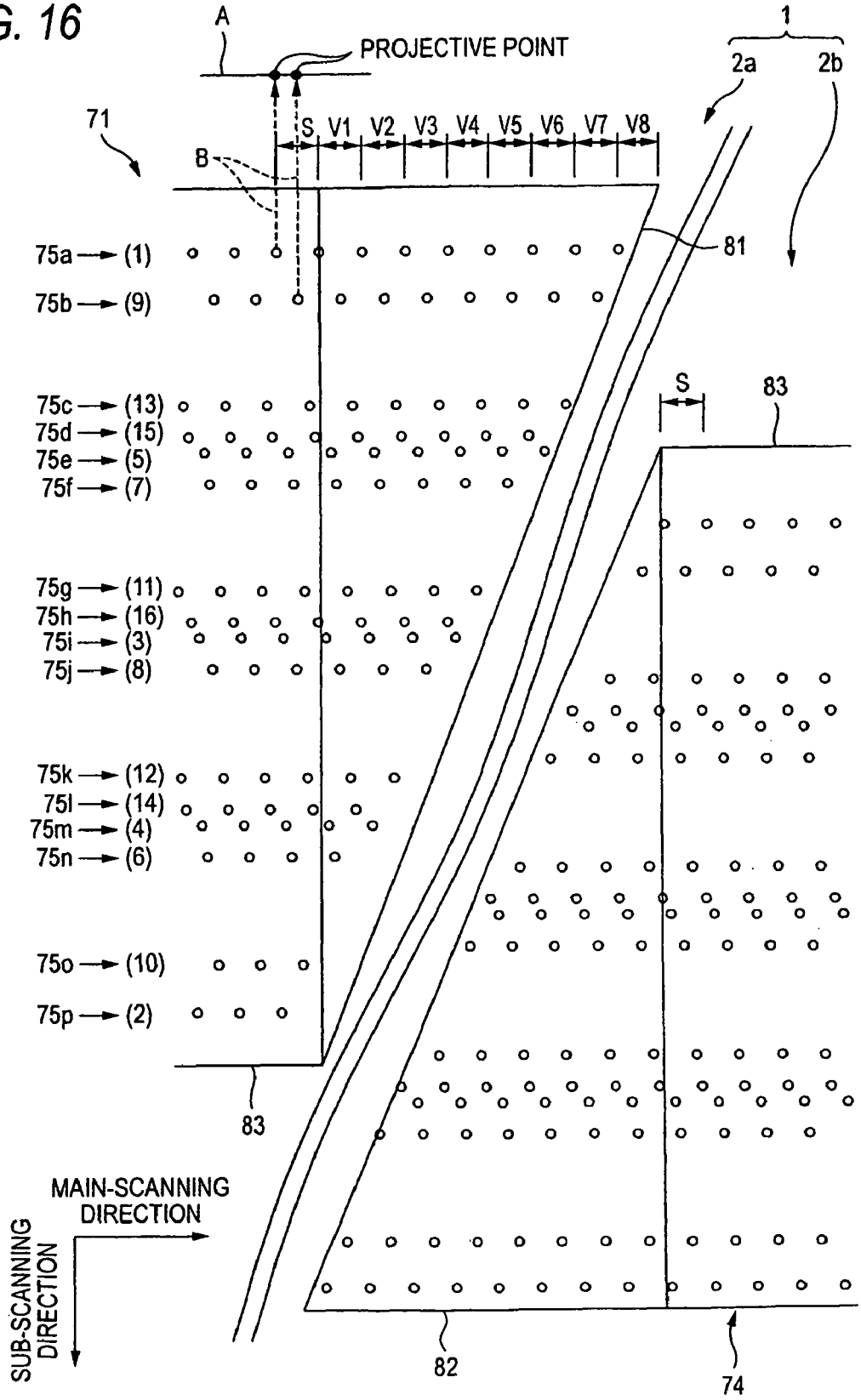
FIG. 16 is a partially enlarged plan view of a head main body of a head set according to a third exemplary embodiment of the present invention when viewed from below.

Next, a description will be given of an ink-jet printer according to a third exemplary embodiment of the present invention by referring to FIG. 16 and FIG. 17. FIG. 16 is a partially enlarged plan view showing a head main body of the head set of the third exemplary embodiment of the present invention, when viewed from below. In addition, FIG. 16 is also drawn by bringing the nozzle group 71 belonging to one ink-jet head 2*a* closer in the sub-scanning direction to the nozzle group 74 belonging to the other ink-jet head 2*b* for easy understanding of the drawing.

Next, a description will be given of an ink-jet printer according to a third exemplary embodiment of the present invention by referring to FIG. 16 and FIG. 17. FIG. 16 is a partially enlarged plan view of a head main body of a head set according to a third exemplary embodiment of the present invention when viewed from below. In addition, FIG. 16 is drawn by bringing the nozzle group 71 belonging to one of the ink-jet heads 2 closer in the sub scanning direction to the nozzle group 74 belonging to the other of the ink-jet heads 2 for the sake of easy understanding of the drawing.

The ink-jet printer of the third exemplary embodiment is similar in constitution to that of the first exemplary embodiment except that a part where the two ink-jet heads 2*a* and 2*b* constituting the head set are overlapped in the sub-scanning direction is different. In addition, the same components as those of the first exemplary embodiment are given the same symbols or numerals, with description omitted here.

As shown in FIG. 16, in the head set of the third exemplary embodiment, two ink-jet heads 2*a* and 2*b* are arranged parallel to each other to constitute one head set 1 in such a manner that the triangular region 81 of the nozzle group 71 of one of the ink-jet heads 2*a* belonging to the head set 1 is overlapped substantially over the entire region in the sub-scanning direction with the triangular region 82 of the nozzle group 74 of the other of the ink-jet heads 2*b*. Additionally, the overlapped triangular regions 81 and 82 are mutually given a complementary relationship with respect to the arrangement of the nozzles 8.

Here, a description will be given in detail of a constitution in which the triangular region 81 of the nozzle group 71 of one of the ink-jet heads 2*a* and the triangular region 82 of the nozzle group 74 of the other of the ink-jet heads 2*b* are overlapped substantially over the entire region in the sub-scanning direction, while the triangular regions 81 and 82 are given a complementary relationship. FIG. 17 is a drawing showing projective points projected on a straight line extending in the main-scanning direction from nozzles belonging to a region where a triangular region of one of the ink-jet head is overlapped in the sub-scanning direction with a triangular region of another of the ink-jet head and the vicinity of the region. In addition, in FIG. 17, white circles represent points projected from the nozzles 8 belonging to the triangular region 82.

FIG. 16 shows a plurality of band regions V1 to V8 having a width (677.3 μm) corresponding to 37.5 dpi in the main-scanning direction and extending in the sub-scanning direction at a region where the triangular region 81 of the nozzle group 71 of the ink-jet head 2*a* and the triangular region 82 of the nozzle group 74 of the ink-jet head 2*b* are overlapped. They are shown sequentially from the left to the right in FIG. 16. Each of the band regions V1 to V7 includes at least one or more of nozzles 8 belonging respectively to the triangular regions 81, 82, with a total of 16 nozzles 8 included. These 16 nozzles 8 all belong to different nozzle rows 75.

Figure 17:
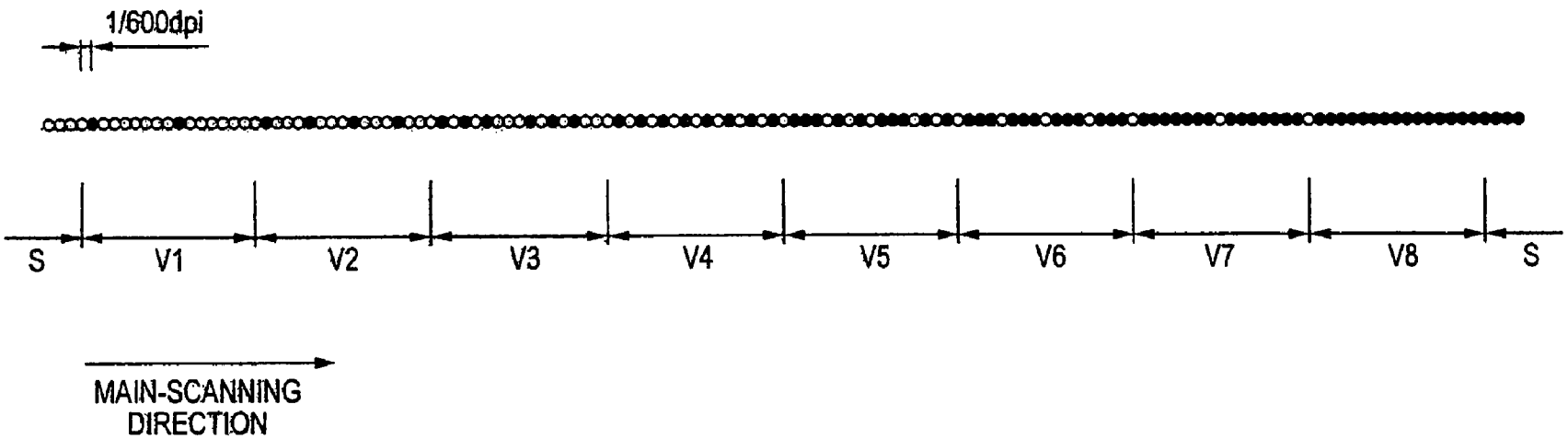
FIG. 17 is a drawing showing projective points projected on a straight line extending in the main-scanning direction from nozzles belonging to a region where a triangular region of one of the ink-jet head is overlapped in the sub-scanning direction with a triangular region of another of the ink-jet head and the vicinity of the region.

As shown in FIG. 17, the 16 nozzles 8 included in each of the eight band regions V1 to V8 are projected on a straight line extending in the main-scanning direction to give projective points. These projective points are arranged on the straight line at equal intervals, and the intervals are equal to a distance (42.3 μm) corresponding to 600 dpi, which is a resolution on printing. In other words, all the nozzles 8 constituting the overlapped triangular regions 81 and 82 are arranged apart at a distance corresponding to 600 dpi in the main-scanning direction.

In addition, as shown in FIG. 17, when consideration is given only to the points projected from the nozzles 8 belonging to the triangular region 81 (white circles) and the points projected from the nozzles 8 belonging to the triangular region 82 (black circles), both of these circles are arranged apart in the main-scanning direction but not arranged at an equal interval or at a distance corresponding to 600 dpi.

As shown in FIG. 17, the band region V1 includes 14 nozzles 8 belonging to the triangular region 81 and two nozzles 8 belonging to the triangular region 82. These 16 nozzles 8 are arranged in the main-scanning direction in such a manner that at least one or more of nozzles 8 belonging to different triangular regions 81, 82 are mutually held therebetween.

More specifically, as shown in FIG. 17, two nozzles 8 belonging to the triangular region 82 hold therebetween seven nozzles 8 belonging to the triangular region 81 in the main-scanning direction. Further, these two nozzles 8 belonging to the triangular region 82 are respectively held at the band region V1 by the first nozzle 8 and the third nozzle 8 and by the ninth nozzle 8 and the eleventh nozzle 8 on the left in FIG. 8 among these nozzles 8 belonging to the triangular region 81.

The band region V2 includes 12 nozzles 8 belonging to the triangular region 81 and four nozzles 8 belonging to the triangular region 82. The band region V3 includes 10 nozzles 8 belonging to the triangular region 81 and six nozzles 8 belonging to the triangular region 82. These 16 nozzles 8 in each of the band regions V2 and V3 are also arranged in the main-scanning direction in such a manner that at least one or more of the nozzles 8 belonging to different triangular regions 81, 82 are mutually held therebetween.

The band region V4 includes eight nozzles 8 belonging to the triangular region 81 and eight nozzles 8 belonging to the triangular region 82. These 16 nozzles 8 are arranged alternately in such a manner that each of the nozzles 8 belonging to different triangular regions 81, 82 is held therebetween in the main-scanning direction.

The band region V5 includes six nozzles 8 belonging to the triangular region 81 and 10 nozzles 8 belonging to the triangular region 82. The band region V6 includes four nozzles 8 belonging to the triangular region 81 and 12 nozzles 8 belonging to the triangular region 82. These 16 nozzles 8 in each of the band regions V5 and V6 are also arranged in the main-scanning direction in such a manner that at least one or more of the nozzles 8 belonging to different triangular regions 81, 82 are mutually held therebetween.

The band region V7 includes two nozzles 8 belonging to the triangular region 81 and 14 nozzles 8 belonging to the triangular region 82. These 16 nozzles 8 are also arranged in the main-scanning direction in such a manner that at least one or more of the nozzles 8 belonging to different triangular regions 81, 82 are mutually held therebetween. The band region V8 includes one nozzle 8 belonging to the triangular region 81 and 15 nozzles 8 belonging to the triangular region 82.

As described above, at the band regions V1 to V8, 16 nozzles 8 in which at least one or more of nozzles 8 belonging to the triangular regions 81, 82 are included are arranged apart at a distance corresponding to 600 dpi in the main-scanning direction, and nozzles 8 belonging to the overlapped triangular regions 81, 82 constitute a complementary relationship. Thereby, printing can be made continuously over the entire width of one ink-jet head 2 in the main-scanning direction.

A net width at which the head set 1 can make a continuous printing is substantially equal to a length obtained by subtracting widths of the triangular region 81 of the nozzle group 71 and the triangular region 82 of the nozzle group 74, the nozzle groups being at the outermost positions in the main-scanning direction, from a width in the main-scanning direction of the eight nozzle groups 71 to 74 belonging to the ink-jet heads 2*a* and 2*b* of the head set 1.

In the thus constituted head set 1, an actuator unit 21 is appropriately driven according to the conveyance of sheets, by which an image having the resolution of 600 dpi can be formed at the printing width of two ink-jet heads 2*a* and 2*b* in the main-scanning direction.

As described above, according to the head unit 5 of the third exemplary embodiment, two ink-jet heads 2*a* and 2*b* are combined in such a manner that a printing region in the main-scanning direction has substantially the same printing region as the printing region of a long ink-jet head (that is, substantially the same printing region as a total printing region obtained by adding printing regions of the two ink-jet heads 2*a* and 2*b* in main-scanning direction), thereby eliminating the necessity for manufacturing a single long ink-jet head and also improving the yield.

Further, the triangular region 81 of the nozzle group 71 of one of the ink-jet heads 2*a* belonging to the head set 1 is overlapped substantially over the entire region in the sub-scanning direction with the triangular region 82 of the nozzle group 74 of the other of the ink-jet heads 2*b*. All the nozzles 8 constituting the overlapped triangular regions 81 and 82 are arranged apart at a distance corresponding to 600 dpi in the main-scanning direction. Therefore, any difference in color tone found on an image formed by one and the other of ink-jet heads 2*a* and 2*b* is made less conspicuous on the border part thereof, because the color tone will be changed gradually at the thus overlapped part.

Further, at any of the band regions V1 to V8 in the overlapped triangular regions 81 and 82, the nozzles 8 respectively belonging to the triangular regions 81 and 82 are distributed and mixed at the same time, thereby the difference in color tone is made even less conspicuous.

Still further, at the band regions V1 to V7 in the overlapped triangular regions 81 and 82, the nozzles 8 belonging to the triangular regions 81 and 82 are arranged so as to hold at least one or more of the nozzles 8 belonging to different triangular regions 81 and 82 therebetween. That is, at least one nozzle included in the triangular regions 81 is disposed between the nozzles included in the triangular region 82 in the main-scanning direction, thereby the difference in color tone is made even less conspicuous. In addition, the band region V8 includes only one of the nozzles 8 belonging to the triangular region 81 and therefore is not arranged in such a manner that the nozzles 8 respectively belonging to the regions 81 and 82 are mutually held therebetween, but the nozzle is held between the nozzles 8 of the triangular region 82 belonging to the band region V7 and the band region V8.

In addition, the nozzle groups 71 to 74 have triangular regions 81 and 82 on both sides holding the rectangular region 83, therebetween in the main-scanning direction. It is, therefore, possible that on constitution of the head set 1, without changing the complementary relationship of the overlapped triangular regions 81 and 82, one of the ink-jet heads 2*a* and 2*b* is arranged obliquely above on the left in FIG. 6 and the other of the ink-jet heads 2*a* and 2*b* is arranged obliquely below on the right. In other words, an increased degree of freedom is given to the arrangement of the ink-jet heads 2*a* and 2*b*. Also, these four nozzle groups 71 to 74 are arrayed in point symmetry on the ink ejecting face 3*a*, thereby making it possible to easily manufacture ink-jet heads 2*a* and 2*b* having multiple nozzle groups 71 to 74.

While the present invention has been shown and described with reference to certain exemplary embodiments thereof, it will be understood by those skilled in the art that various changes in form and details may be made therein without departing from the spirit and scope of the invention as defined by the appended claims.

For example, the head set 1 of the above embodiments is made up of two ink-jet heads 2*a* and 2*b*, but three or more ink-jet heads may be arrayed so that the printing region can extend in the main-scanning direction. Further, the head unit 5 has four head sets 1 but may have 1 to 3 and 5 or more head sets. Still further, 4 nozzle groups 71 to 74 are formed on the ink-jet head 2 but 1 to 3 and 5 or more nozzle groups may be formed thereon. Triangular regions outside the outermost nozzle groups in the main-scanning direction may not be provided upon constitution of the head set. In addition, it adjacent nozzle groups 71 to 74 retain the complementary relationship, they may not be arrayed in point symmetry with respect to the center point 60 on the ink ejecting face.

Further, as long as a nozzle group formed on the ink-jet head 2 is constituted with a triangular region and a rectangular region, as described above, it is not limited to a trapezoid shape in the outer shape but may include a parallelogram and a combination of the trapezoid shape and the parallelogram shape. In any case, it is desired that the oblique sides of the triangular region are arranged parallel to each other between adjacent nozzle groups. In other words, a plurality of nozzle groups in which a plurality of nozzles are arrayed in a matrix-like manner are installed together at a predetermined group interval in the long side direction of the ink-jet head 2. These nozzle groups have at least one type of the trapezoid shape and the parallelogram shape. Further, such a constitution is provided that a plurality of these nozzle groups are arranged alternately in an equal distance in an eccentric manner in the opposite direction parallel to the shorter side with respect to the center in the shorter side direction of the ink-jet head 2. Thereby, the ink-jet head 2 is formed compactly both in the long side direction and in the short side direction, thereby providing the head unit 5, which is compact in size as a whole even on assembly of a plurality of the ink-jet heads 2.

Further, adjacent nozzle groups may have the point symmetry relationship to each other. Thereby, a region occupied by nozzle groups is available only in one type of the outer shape. In this instance, the actuator unit 21 is available only in one type, thus making it possible to easily manufacture the ink-jet head and contribute to a decrease in cost.

The present invention provides illustrative non-limiting embodiments as follows:

A head unit comprises; first and second heads, each having an ink ejecting face including a nozzle group, the nozzle group including a plurality of nozzle rows extending in a first direction and arranged in a second direction orthogonal to the first direction, each nozzle row including a plurality of nozzles for ejecting ink arranged along the first direction at a predetermined interval; and a holder for holding the first and second heads, wherein each of the nozzle groups of the first and second heads includes a rectangular region in which the plurality of nozzles are arranged apart at a predetermined distance in the first direction to form a rectangular shape, and wherein the first and second heads are held by the holder in parallel with each other so that the plurality of nozzles included in the rectangular regions of the first and second heads, respectively, are arranged apart at the predetermined distance in the first direction.

According to the above configuration, a plurality of heads can be assembled to constitute a head unit having the same printing region as that of a single long ink-jet head, thereby making it possible to attain a higher yield than the manufacture of a single long ink-jet head. It is also possible to easily control a plurality of heads which constitute the head unit.

The rectangular regions of the first and second heads may be partially overlapped with each other in the second direction.

According to the above configuration, since the two rectangular regions belonging to mutually different heads are partially overlapped in the second direction, a white streak resulting from an error in assembly on assembly of a plurality of heads on a holder is less likely to develop on an image when it is printed.

Each of the nozzle groups of the first and second heads may further include a triangular region which has one side extending in the second direction and common to one side of the corresponding rectangular region, and in which the plurality of nozzles are arranged in the first direction to form a triangular shape. The triangular region of the first head may be overlapped with an overlapped portion of the rectangular region of the second head in the second direction. The triangular region of the second head may be overlapped with an overlapped portion of the rectangular region of the first head in the second direction. The plurality of the nozzles included in the triangular regions of the first and second heads and included in the overlapped portions of the rectangular regions of the first and second heads may be arranged apart at the predetermined distance in the first direction.

According to the above configuration, a difference in color tone found on an image formed by individual heads is made less conspicuous since the color tone is allowed to change gradually at a part where the triangular region and a portion of the rectangular region belonging to mutually different heads are overlapped.

If a band region having a width equal to the predetermined interval and extending in the second direction is set in the triangular regions of the first and second heads and the overlapped portions of the rectangular regions of the first and second heads, within the band region set in any range, the nozzles included in the plurality of the nozzle rows in each of the rectangular regions of the first and second heads may be arranged apart at the predetermined distance in the first direction without overlapping with each other in the second direction, within the band region set in any range in the triangular region of the first head and the overlapped portion of the rectangular region of the second head, at least one nozzle may be included in the triangular region of the first head and at least one nozzle may be included in the overlapped portion of the rectangular region of the second head, and within the band region set in any range in the triangular region of the second head and the overlapped portion of the rectangular region of the first head, at least one nozzle may be included in the triangular region of the second head and at least one nozzle may be included in the overlapped portion of the rectangular region of the first head.

According to the above configuration, the difference in color tone is made even less conspicuous since at any of the band regions inside a range corresponding to the triangular region at one end and a portion of the rectangular region belonging to a different ink-jet head that are overlapped, and also inside a range corresponding to the triangular region at the other end and a portion of the rectangular region belonging to one ink-jet head that are overlapped, nozzles constituting both of them are mixed at the same time.

Each of the nozzles included in the triangular region of the first head may be overlapped with any of the nozzles included in the rectangular region of the second head in the second direction. The nozzles included in the rectangular region of the second head may be classified into first nozzles which are overlapped with any of the nozzles included in the triangular region of the first head in the second direction, and second nozzles which are not overlapped with any of the nozzles included in the triangular region of the first head in the second direction.

Within the band region set in any range in the triangular region of the first head at a side of the rectangular region of the first head from a center band region in the first direction, each of the second nozzles may be disposed between two of the first nozzles in the first direction. Within the band region set in any range in the triangular region of the first head at an opposite side to the side of the rectangular region of the first head from the center band region in the first direction, each of the first nozzles may be disposed between two of the second nozzles in the first direction.

According to the above configuration, the difference in color tone is made even less conspicuous since many band regions inside a range corresponding to the triangular region at one end and a portion of the rectangular region belonging to a different head that are overlapped, have a part where nozzles belonging to the triangular region at one end are held between the nozzles belonging to the rectangular region of a different head.

Each of the nozzles included in the triangular region of the second head may be overlapped with any of the nozzles included in the rectangular region of the first head in the second direction. The nozzles included in the rectangular region of the first head may be classified into third nozzles which are overlapped with any of the nozzles included in the triangular region of the second head in the second direction, and fourth nozzles which are not overlapped with any of the nozzles included in the triangular region of the second head in the second direction.

Within the band region set in any range in the triangular region of the second head at a side of the rectangular region of the second head from a center band region in the first direction, each of the fourth nozzles may be disposed between two of the third nozzles in the first direction. Within the band region set in any range in the triangular region of the second head at an opposite side to the side of the rectangular region from the center band region in the first direction, each of the third nozzles may be disposed between two of the fourth nozzles in the first direction.

According to the above configuration, the difference in color tone is made less conspicuous since many band regions inside a range corresponding to the triangular region at the other end and a portion of the rectangular region belonging to one head that are overlapped, have a part where nozzles belonging to the triangular region at the other end are held between the nozzles belonging to the rectangular region of the one head.

Each of the nozzle groups may further include another triangular region which has one side extending in the second direction and common to the other side of the corresponding rectangular region in the first direction. Each of the ink ejecting faces may include a plurality of nozzle groups arranged in the first direction so that the triangular regions included in adjacent nozzle groups are entirely overlapped with each other in the second direction. The nozzles included in the triangular regions of adjacent nozzle groups may be arrange apart at the predetermined distance in the first direction.

According to the above configuration, a plurality of ink-jet heads having a plurality of nozzle groups can be used to constitute a head unit.

The plurality of the nozzle groups in each of the first and second heads may be arrayed in point symmetry with respect to a center of the corresponding ink ejecting face.

According to the above configuration, a region occupied by the nozzle groups can be made only in one shape, thus making it possible to easily manufacture an ink-jet head having a plurality of the nozzle groups which constitute the head unit.

The rectangular regions of the first and second heads may be partially overlapped with each other in the second direction.

According to the above configuration, since the two rectangular regions belonging to the mutually different heads are partially overlapped in the second direction, a white streak resulting from an error in assembly on assembly of a plurality of ink-jet heads on a holder is less likely to develop on an image when it is printed.

An ink-jet recording apparatus comprises: the head unit as described above; and a controller which controls the head unit so that ink is ejected only from nozzles included in one of the rectangular regions of the first and second head at a part where the rectangular regions are overlapped with each other in the second direction.

According to the above configuration, there is provided an ink-jet recording device having a head unit which is higher in yield than the manufacture of a single long ink-jet head. It is also possible to attain easy control so that ink is ejected only from one of two ranges at which two rectangular regions are overlapped.

An ink-jet recording apparatus comprises: the head unit as described above; and a controller which controls the head unit to selectively eject ink.

The controller may control the head unit so that ink is not ejected from the nozzles included in the triangular regions overlapped with the rectangular regions in the second direction and ink is ejected only from the nozzles included in one of the rectangular regions of the first and second head at a region where the rectangular regions are overlapped with each other in the second direction.

According to the above configuration, there is provided an ink-jet recording device having the head unit which is higher in yield than the manufacture of a single long ink-jet head. It is also possible to attain easy control.

The controller may control the head unit so that ink is not ejected from nozzles included in the rectangular region overlapped with the nozzles in the triangular region in the second direction and ink is ejected only from one of the rectangular regions of the first and second head at a part where the rectangular regions are overlapped with each other in the second direction.

According to the above configuration, there is provided an ink-jet recording device having the head unit higher in yield than the manufacture of a single long ink-jet head. Further, such easy control can be attained. Still further, the color tone is allowed to change gradually at a part where the triangular region and a portion of the rectangular region belonging to mutually different heads are overlapped, thereby, a difference in color tone found on an image formed by each of the ink-jet heads is made less conspicuous.

An ink-jet recording device comprises: a head unit as described above; and a controller which controls the head unit so that ink is not ejected from nozzles included in the rectangular region overlapped with the nozzles in the triangular region in the second direction and ink is ejected from the nozzles included in the triangular regions.

According to the above configuration, there is provided an ink-jet recording device having a head unit higher in yield than the manufacture of a single long ink-jet head. Further, such easy control can be attained. Still further, the color tone is allowed to change gradually at a part where the triangular region and a portion of the rectangular region belonging to mutually different ink-jet heads are overlapped, thereby a difference in color tone found on an image formed by each of the ink-jet heads is made less conspicuous.

A head unit comprises: first and second heads, each having an ink ejecting face including a nozzle group, the nozzle group including a plurality of nozzle rows extending in a first direction and arranged in a second direction orthogonal to the first direction, each nozzle row including a plurality of nozzles for ejecting ink arranged along the first direction at a predetermined interval; and a holder for holding the first and second heads, wherein each of the nozzle groups of the first and second heads includes: a rectangular region in which the plurality of nozzles are arranged apart at a predetermined distance in the first direction to form a rectangular shape; and a triangular region which has one side extending in the second direction and common to one side of the corresponding rectangular region, and in which the plurality of nozzles are arranged in the first direction to form a rectangular shape, wherein the first and second heads are held by the holder in parallel with each other so that the triangular regions of the first and second heads are substantially entirely overlapped with each other, and wherein the plurality of nozzles included in the triangular regions of the first and second heads are arranged apart at the predetermined distance in the first direction.

According to the above configuration, a plurality of heads can be assembled to constitute a head unit having the same printing region as that of a long ink-jet head, thereby making it possible to attain a higher yield than the manufacture of a single long ink-jet head. Further, a difference in color tone found on an image formed by individual ink-jet heads is made less conspicuous, because the color tone is allowed to change gradually at a part of the overlapped triangular regions.

If a band region having a width equal to the predetermined interval and extending in the second direction is set in the triangular regions of the first and second heads overlapped with each other, within the band region set in any range in the triangular regions of the first and second heads overlapped with each other, at least one nozzle may be included in the triangular region of the first head and at least one nozzle is included in the triangular region of the second head.

According to the above configuration, the difference in color tone is made even less conspicuous since the nozzles constituting triangular regions at one end and the other end are mixed at the same time in any of the band regions.

Within the band region set in any range except for a band region in which the number of the nozzles included in the triangular region of either the first or second head is one, at least one nozzle included in the triangular region of the first head may be disposed between two of the nozzles included in the triangular region of the second head in the first direction.

According to the above configuration, the difference in color tone is made even less conspicuous Each of the nozzle groups may further include another triangular region which has one side extending in the second direction and common to the other side of the corresponding rectangular region in the first direction.

According to the above configuration, the nozzle group has the triangular regions on both sides of the rectangular region in one direction, thus making it possible to increase the degree of freedom on assembly of a plurality of ink-jet heads.

The plurality of the nozzle groups in each of the first and second heads may be arrayed in point symmetry with respect to a center of the corresponding ink ejecting face.

According to the above configuration, it is possible to easily manufacture an ink-jet head having multiple nozzle groups.

What is claimed is:

1. A head unit comprising:

first and second heads, each having an ink ejecting face including a nozzle group, the nozzle group including a plurality of nozzle rows extending in a first direction and arranged in a second direction orthogonal to the first direction, each nozzle row including a plurality of nozzles for ejecting ink arranged along the first direction at a predetermined interval; and a holder for holding the first and second heads, wherein each of the nozzle groups of the first and second heads includes:

a rectangular region in which the plurality of nozzles are arranged apart at a predetermined distance in the first direction to form a rectangular shape, and a triangular region which has one side extending in the second direction and common to one side of the corresponding rectangular region, and in which the plurality of nozzles are arranged in the first direction to form a triangular shape, wherein the first and second heads are held by the holder in parallel with each other so that the plurality of nozzles included in the rectangular regions of the first and second heads, respectively, are arranged apart at the predetermined distance in the first direction, and wherein the triangular region of the first head is overlapped with an overlapped portion of the rectangular region of the second head in the second direction, wherein the triangular region of the second head is overlapped with an overlapped portion of the rectangular region of the first head in the second direction, and wherein the plurality of the nozzles included in the triangular regions of the first and second heads and included in the overlapped portions of the rectangular regions of the first and second heads are arranged apart at the predetermined distance in the first direction.

2. The head unit according to claim 1, wherein the rectangular regions of the first and second heads are partially overlapped with each other in the second direction.

3. The head unit according to claim 2, wherein if a band region having a width equal to the predetermined interval and extending in the second direction is set in the triangular regions of the first and second heads and the overlapped portions of the rectangular regions of the first and second heads, within the band region set in any range, the nozzles included in the plurality of the nozzle rows in each of the rectangular regions of the first and second heads are arranged apart at the predetermined distance in the first direction without overlapping with each other in the second direction, within the band region set in any range in the triangular region of the first head and the overlapped portion of the rectangular region of the second head, at least one nozzle is included in the triangular region of the first head and at least one nozzle is included in the overlapped portion of the rectangular region of the second head, and within the band region set in any range in the triangular region of the second head and the overlapped portion of the rectangular region of the first head, at least one nozzle is included in the triangular region of the second head and at least one nozzle is included in the overlapped portion of the rectangular region of the first head.

4. The head unit according to claim 3, wherein each of the nozzles included in the triangular region of the first head is overlapped with any of the nozzles included in the rectangular region of the second head in the second direction, wherein the nozzles included in the rectangular region of the second head are classified into first nozzles which are overlapped with any of the nozzles included in the triangular region of the first head in the second direction, and second nozzles which are not overlapped with any of the nozzles included in the triangular region of the first head in the second direction.

5. The head unit according to claim 4, wherein, within the band region set in any range in the triangular region of the first head at a side of the rectangular region of the first head from a center band region in the first direction, each of the second nozzles is disposed between two of the first nozzles in the first direction, and wherein, within the band region set in any range in the triangular region of the first head at an opposite side to the side of the rectangular region of the first head from the center band region in the first direction, each of the first nozzles is disposed between two of the second nozzles in the first direction.

6. The head unit according to claim 5, wherein each of the nozzles included in the triangular region of the second head is overlapped with any of the nozzles included in the rectangular region of the first head in the second direction, wherein the nozzles included in the rectangular region of the first head are classified into third nozzles which are overlapped with any of the nozzles included in the triangular region of the second head in the second direction, and fourth nozzles which are not overlapped with any of the nozzles included in the triangular region of the second head in the second direction.

7. The head unit according to claim 6, wherein, within the band region set in any range in the triangular region of the second head at a side of the rectangular region of the second head from a center band region in the first direction, each of the fourth nozzles is disposed between two of the third nozzles in the first direction, and wherein, within the band region set in any range in the triangular region of the second head at an opposite side to the side of the rectangular region from the center band region in the first direction, each of the third nozzles is disposed between two of the fourth nozzles in the first direction.

8. The head unit according to claim 2, wherein each of the nozzle groups further includes another triangular region which has one side extending in the second direction and common to the other side of the corresponding rectangular region in the first direction, wherein each of the ink ejecting faces includes a plurality of nozzle groups arranged in the first direction so that the triangular regions included in adjacent nozzle groups are entirely overlapped with each other in the second direction, and wherein the nozzles included in the triangular regions of adjacent nozzle groups are arrange apart at the predetermined distance in the first direction.

9. The head unit according to claim 8, wherein the plurality of the nozzle groups in each of the first and second heads are arrayed in point symmetry with respect to a center of the corresponding ink ejecting face.

10. The head unit according to claim 2, wherein the rectangular regions of the first and second heads are partially overlapped with each other in the second direction.

11. An ink jet recording apparatus comprising:

the head unit according to claim 10; and a controller which controls the head unit to selectively eject ink.

12. The ink jet recording apparatus according to claim 11, wherein the controller controls the head unit so that ink is not ejected from the nozzles included in the triangular regions overlapped with the rectangular regions in the second direction and ink is ejected only from the nozzles included in one of the rectangular regions of the first and second head at a region where the rectangular regions are overlapped with each other in the second direction.

13. The ink-jet recording apparatus according to claim 11, wherein the controller controls the head unit so that ink is not ejected from nozzles included in the rectangular region overlapped with the nozzles in the triangular region in the second direction and ink is ejected only from one of the rectangular regions of the first and second head at a part where the rectangular regions are overlapped with each other in the second direction.

14. An ink jet recording apparatus comprising:

the head unit according to claim 2; and a controller which controls the head unit so that ink is ejected only from nozzles included in one of the rectangular regions of the first and second head at a part where the rectangular regions are overlapped with each other in the second direction.

15. An ink jet recording device comprising:

a head unit according to claim 2; and a controller which controls the head unit so that ink is not ejected from nozzles included in the rectangular region overlapped with the nozzles in the triangular region in the second direction and ink is ejected from the nozzles included in the triangular regions.

16. A head unit comprising:

first and second heads, each having an ink ejecting face including a nozzle group, the nozzle group including a plurality of nozzle rows extending in a first direction and arranged in a second direction orthogonal to the first direction, each nozzle row including a plurality of nozzles for ejecting ink arranged along the first direction at a predetermined interval; and a holder for holding the first and second heads, wherein each of the nozzle groups of the first and second heads includes:

a rectangular region in which the plurality of nozzles are arranged apart at a predetermined distance in the first direction to form a rectangular shape; and a triangular region which has one side extending in the second direction and common to one side of the corresponding rectangular region, and in which the plurality of nozzles are arranged in the first direction to form a rectangular shape, wherein the first and second heads are held by the holder in parallel with each other so that the triangular regions of the first and second heads are substantially entirely overlapped with each other, wherein the plurality of nozzles included in the triangular regions of the first and second heads are arranged apart at the predetermined distance in the first direction, wherein if a band region having a width equal to the predetermined interval and extending in the second direction is set in the triangular regions of the first and second heads overlapped with each other, and within the band region set in any range in the triangular regions of the first and second heads overlapped with each other, at least one nozzle is included in the triangular region of the first head and at least one nozzle is included in the triangular region of the second head.

17. The head unit according to claim 16, wherein within the band region set in any range except for a band region in which the number of the nozzles included in the triangular region of either the first or second head is one, at least one nozzle included in the triangular region of the first head is disposed between two of the nozzles included in the triangular region of the second head in the first direction.

18. The head unit according to claim 16, wherein each of the nozzle groups further includes another triangular region which has one side extending in the second direction and common to the other side of the corresponding rectangular region in the first direction.

19. The head unit according to claim 18, wherein the plurality of the nozzle groups in each of the first and second heads are arrayed in point symmetry with respect to a center of the corresponding ink ejecting face.

* * * * *